US012331953B2

(12) United States Patent
Buffa et al.

(10) Patent No.: US 12,331,953 B2
(45) Date of Patent: Jun. 17, 2025

(54) HVAC DRIP LINE DEVICE

(71) Applicants: Ronald Buffa, Sebastian, FL (US); Stephen Eisenmann, Vero Beach, FL (US)

(72) Inventors: Ronald Buffa, Sebastian, FL (US); Stephen Eisenmann, Vero Beach, FL (US)

( * ) Notice: Subject to any disclaimer, the term of this patent is extended or adjusted under 35 U.S.C. 154(b) by 302 days.

(21) Appl. No.: 17/961,031

(22) Filed: Oct. 6, 2022

(65) Prior Publication Data

US 2023/0111181 A1 Apr. 13, 2023

Related U.S. Application Data

(60) Provisional application No. 63/254,066, filed on Oct. 9, 2021.

(51) Int. Cl.
*F24F 13/22* (2006.01)

(52) U.S. Cl.
CPC ..... *F24F 13/222* (2013.01); *F24F 2013/228* (2013.01)

(58) Field of Classification Search
CPC ..... F24F 13/222; F24F 13/227; F24F 13/228; F24F 2140/30; F24F 2013/148; F16K 21/185; F16K 31/02; F16K 31/06; F16K 31/0655; F16K 31/0665; F16K 99/0046; F28F 17/00; F28F 17/005; F25D 2321/14; F25D 2321/146
See application file for complete search history.

(56) References Cited

U.S. PATENT DOCUMENTS

| | | | | |
|---|---|---|---|---|
| 10,246,358 | B1 * | 4/2019 | Lohse | C02F 1/686 |
| 2009/0165868 | A1 * | 7/2009 | Pearson | B60H 1/3233 137/240 |
| 2011/0049401 | A1 * | 3/2011 | Chung | F16K 99/0001 29/890.131 |
| 2016/0058899 | A1 * | 3/2016 | Mansor | A61L 2/18 422/116 |
| 2020/0070217 | A1 * | 3/2020 | Rose | F24F 13/222 |

* cited by examiner

*Primary Examiner* — Joseph F Trpisovsky
(74) *Attorney, Agent, or Firm* — CF 3; Stephen Eisenmann

(57) ABSTRACT

Examples disclosed herein relate to a condensation device including a reservoir including one or more elements, a power supply, and a controller configured to receive time data and to control a device to transport the one or more elements to a condensation stream.

5 Claims, 18 Drawing Sheets

HVAC DRIP LINE DEVICE

REFERENCE

The present application claims priority to Provisional Patent Application No. 63/254,066 filed Oct. 9, 2021 which is incorporated in its entirety by reference.

FIELD

The subject matter disclosed herein relates to reducing and/or eliminating sludge, bacteria growth, and/or any other element that stops the flow of fluids through a drain line. More specifically, to a method, system, and/or device that functions to reduce inhibitors to fluid (e.g., water, etc.) flow through one or more outlets of a Heating, Ventilation, and Air Conditioning ("HVAC") system.

INFORMATION

The HVAC industry has numerous ways to transport one or more fluids and/or gases. This disclosure highlights enhanced devices, methods, and systems for transporting these one or more fluids and/or gases.

BRIEF DESCRIPTION OF THE FIGURES

Non-limiting and non-exhaustive examples will be described with reference to the following figures, wherein like reference numerals refer to like parts throughout the various figures.

DETAILED DESCRIPTION OF THE DISCLOSURE

Figure 1A:
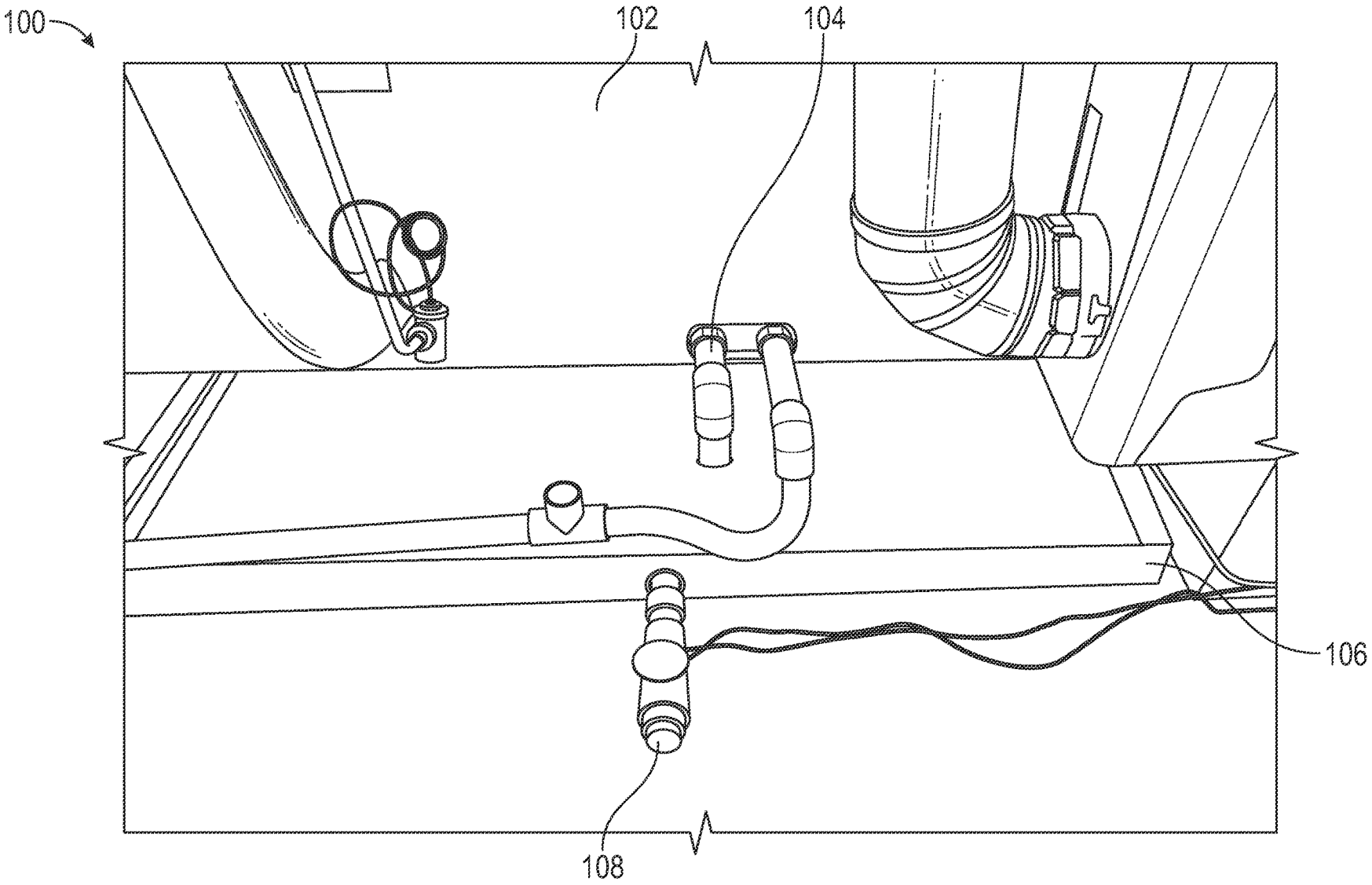
FIG. 1A is an illustration of a first portion of an HVAC system, according to one embodiment.

In FIG. 1A, an illustration of a first portion of an HVAC system 100 is shown, according to one embodiment. The portion of the HVAC system 100 may include an evaporator enclosure 102, a condensation drain tube 104, a drip pan 106, and/or a condensation water to outside line 108. In this example, condensation from one or more parts (e.g., evaporator, etc.) of the HVAC system is deposited (e.g., flows to) on the drip pan 106. The condensation may then flow from the drip pan 106 to the condensation water to the outside line 108. Further, the condensation water to the outside line 108 may flow to the outside portion of the condensation water to outside line 110 (See FIG. 1B). In one example, the condensation water may allow the growth of bacteria, sludge, or any blocking element to build up and/or grow. In one example, the bacteria growth may be based on temperature conditions and the PH level of the condensation water. The standard practice in the industry today is to vacuum out the bacteria (and/or sludge and/or any other blocking element) on a regular basis to remove this growth. In addition, a cleaning element may be utilized on a regular basis (e.g., every month, every two months, every three months, etc.) to clean out the line. All of these processes (e.g., vacuuming, utilizing a cleaning element, etc.) are completed manually which causes numerous issues. For example, there is a cost (e.g., $150 to $250) associated with having an HVAC technical person visit the unit and vacuum out and/or clean out the condensation line. In addition, the HVAC owner must remember to schedule the maintenance with the HVAC contractor and/or remember to complete the maintenance if the HVAC owner is doing this maintenance themselves. In addition, if the maintenance is not completed, then the condensation line could become clogged, which causes at least two major issues. First, the HVAC system will stop running and this normally happens when the HVAC system is needed the most (e.g., hot weather). Second, the condensation fluid overflows causing damage to drywall and/or other material which needs to be fixed and/or cleaned up. In the example of drywall being damaged, the drywall must be removed because of mold issues, new drywall must be installed, and the drywall is typically painted. In the first example where the HVAC system stops working, an HVAC technical person must come out (which can take hours or days) to fix the problem. The space that is no longer being conditioned is no longer useable for its intended purposes which reduces utilization and productivity which has a cost. Further, there is the cost for the HVAC technical person visit to fix the issue. In the second example where the condensation overflows and damages material, there may be the same cost for the HVAC technical person's visit to fix the issue, along with the cost to clean up and/or repair the damaged material.

Figure 1B:
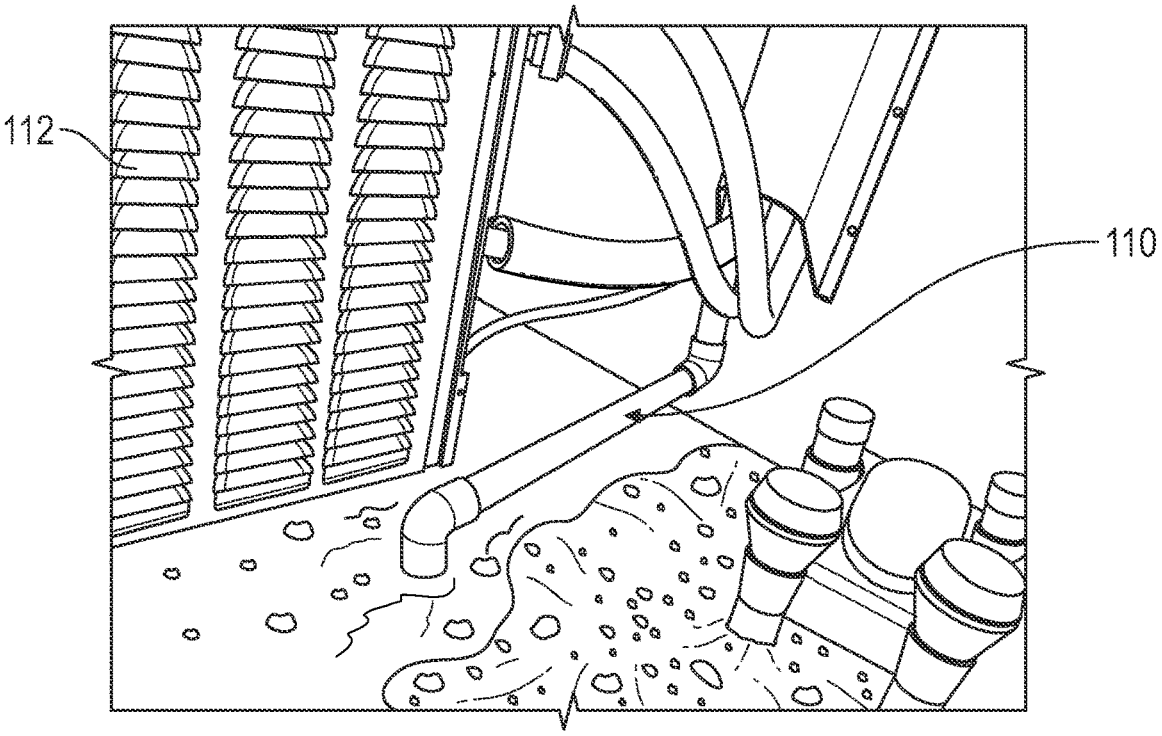
FIG. 1B is an illustration of a second portion of an HVAC system, according to one embodiment.

In FIG. 1B, an illustration of a second portion of an HVAC system is shown, according to one embodiment. The second portion of the HVAC system may include an outside portion of the condensation water to outside line 110 and/or a condenser unit 112. In one example, the water and outside temperature allow for the growth of bacteria on the condensation line, which can be seen in FIG. 5A (reference number 542).

Figure 1C:
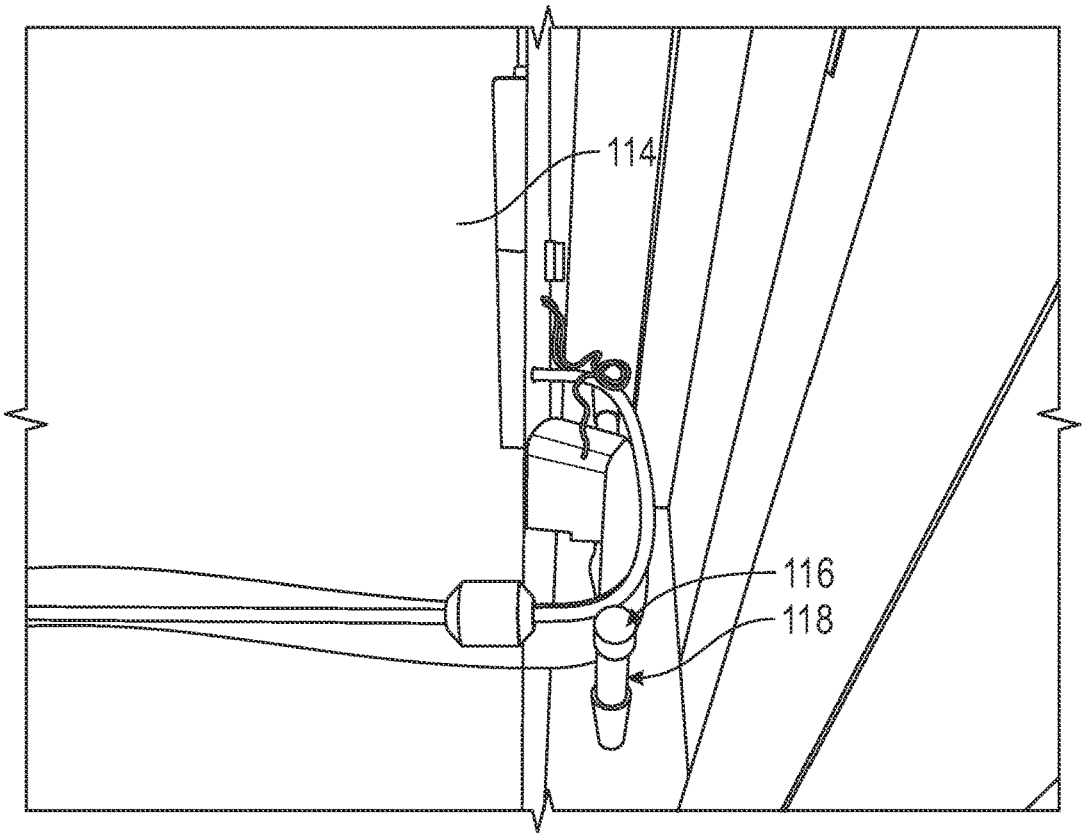
FIG. 1C is an illustration of a third portion of an HVAC system, according to one embodiment.

In FIG. 1C, an illustration of a third portion of an HVAC system is shown, according to one embodiment. The third portion of the HVAC system shows an alternative design which may include an evaporator enclosure 114, a cap 116 for a condensation line, and/or a condensation water to outside line 118. In this example, access to the condensation line is obtained via removal of the cap 116.

Figure 2A:
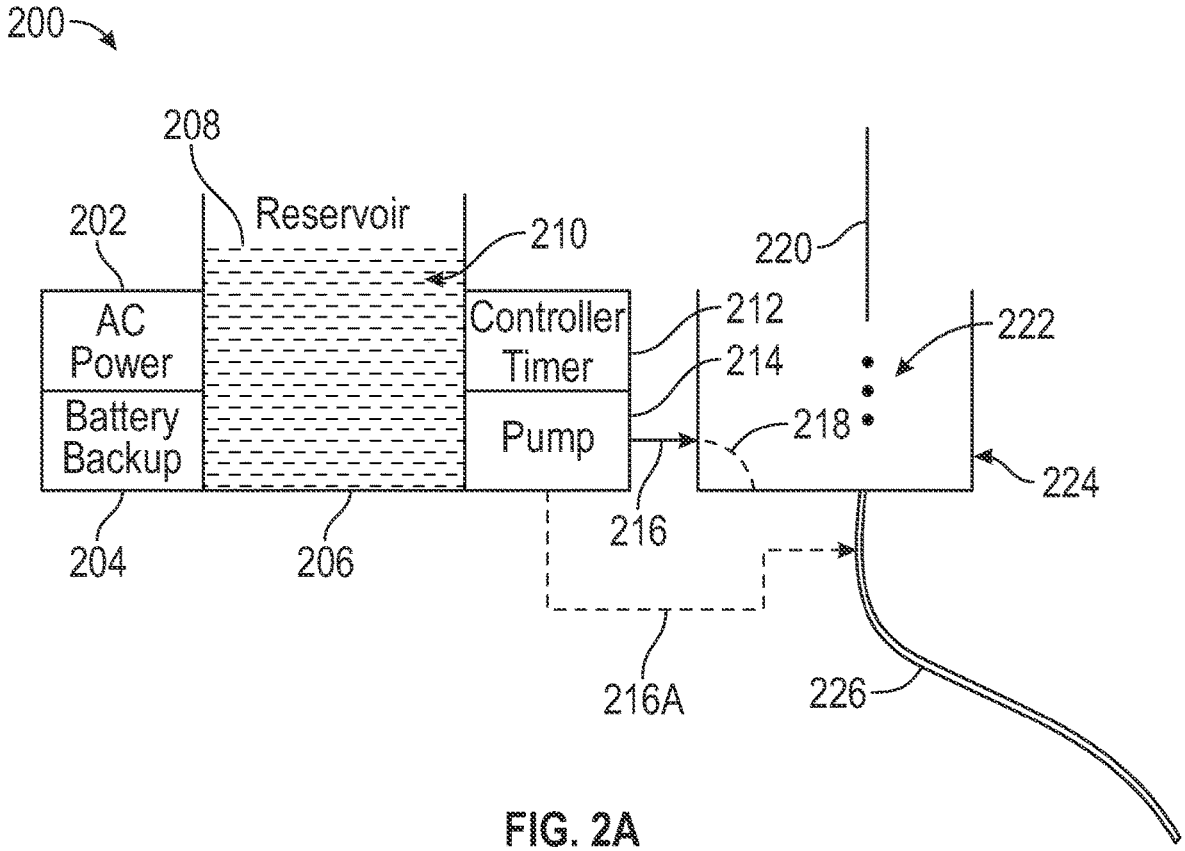
FIG. 2A is an illustration of a drip line device, according to one embodiment.

In FIG. 2A, an illustration of a drip line device 200 is shown, according to one embodiment. Drip line device 200 may include a power source 202, a battery backup source 204, a reservoir 206, an element (e.g., water, sodium hydroxide, vinegar, chlorine, bleach, citric acid, sodium hypochlorite, ammonia, detergent, etc.) 210, a level 208 of the element 210, a controller 212, and/or a pump 214. The drip line device 200 may transport the element 210 via the pump 214 to a drip pan 224 and/or condensation line 226 to the outside line. The transportation may occur via a first path and/or line 216 and/or via a second path and/or line 216A. The first path and/or line 216 may be released into the drip pan 224 via a spraying function 218, a dripping function, and/or any other function described in this disclosure. Further, the second path and/or line 216A may be released into the condensation line 226 to the outside line via a dripping function, a spraying function, and/or any other function described in this disclosure. Further, the drip pan 224 may receive condensation 222 (e.g., water, etc.) from a condensation drain line 220 which may come from the evaporator coil and/or any other source of condensation.

Power source 202 may be AC or DC power and utilize any voltage level. Further, power source 202 could be sourced from a utility, could be solar, could be vibrational, batteries, and/or any other power source. Battery backup source 204 may be any type of battery and/or any other power source. The reservoir 206 may be made of plastic, steel, glass, aluminum, copper, and/or any other building material. The element 210 may be water, sodium hydroxide, vinegar, chlorine, bleach, citric acid, sodium hypochlorite, ammonia, detergent, and/or any combination thereof. The level 208 of the element 210 may be 100 percent, 99 percent, 98 percent, all the way down to zero percent going in any increment from 1 percent increments to 0.1 percent increments. The controller 212 may utilize time, element level, sensor data, camera data, and/or any other data in this disclosure to control the amount and/or timing of a treatment material release and/or treatment procedure. The pump 214 may utilize gas, electricity, liquids, and/or any other source to move one or more elements. The movement of the one or more elements may occur from the reservoir 206 to the condensation line 226 and/or the drip pan 224 and/or any other locations in this disclosure.

The one or more elements (e.g., water, sodium hydroxide, vinegar, chlorine, bleach, citric acid, sodium hypochlorite, ammonia, detergent, etc.) 210 either cleans out the condensation line and/or changes the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

In one example, the reservoir 206 may hold a volume of 56 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 212 may control the flow of the element 210 based on time data. In this example, the controller 212 may send a signal to the pump 214 every thirty days to release 4.6 ounces of element 210 at a flow rate of 1 ounce per second. In various examples, the flow rate that is utilized may be less than the flow rate that would cause the condensation line 226 and/or drip pan 224 to overflow.

In another example, the reservoir 206 may hold a volume of 56 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 212 may control the flow of the element 210 based on time data. In this example, the controller 212 may send a signal to the pump 214 every fourteen days to release 2.0 ounces of element 210 at a flow rate of 0.5 ounces per second into the condensation line 226 and/or drip pan 224.

In another example, the reservoir 206 may hold a volume of 56 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 212 may control the flow of the element 210 based on time data. In this example, the controller 212 may send a signal to the pump 214 every seven days to release 1.0 ounce of element 210 at a flow rate of 0.25 ounces per second (and/or 0.1 ounces per minute, and/or 0.1 ounces per house and/or 1.0 ounce per second) into the condensation line 226 and/or drip pan 224.

In another example, the reservoir 206 may hold a volume of 56 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 212 may control the flow of the element 210 based on time data. In this example, the controller 212 may send a signal to the pump 214 every day to release 0.15 ounces of element 210 at a flow rate of 0.15 ounces per second into the condensation line 226 and/or drip pan 224.

In another example, the reservoir 206 may hold a volume of 52 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 212 may control the flow of the element 210 based on time data. In this example, the controller 212 may send a signal to the pump 214 every seven days to release 1.0 ounces of element 210 at a flow rate of 0.2 ounces per second into the condensation line 226 and/or drip pan 224.

In another example, the reservoir 206 may hold a volume of 100 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 212 may control the flow of the element 210 based on time data. In this example, the controller 212 may send a signal to the pump 214 every 12 hours to release 0.1369 ounces of element 210 at a flow rate of 0.02 ounces per 30 minutes into the condensation line 226 and/or drip pan 224.

In another example, the reservoir 206 may hold a volume of 100 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 212 may control the flow of the element 210 based on time data. In this example, the controller 212 may send a signal to the pump 214 every 12 hours to release 0.1369 ounces of element 210 at a flow rate of 0.001 (or within a range of 0.0002 to 0.002 ounces per minute) ounces per minute into the condensation line 226 and/or drip pan 224.

Figure 2B:
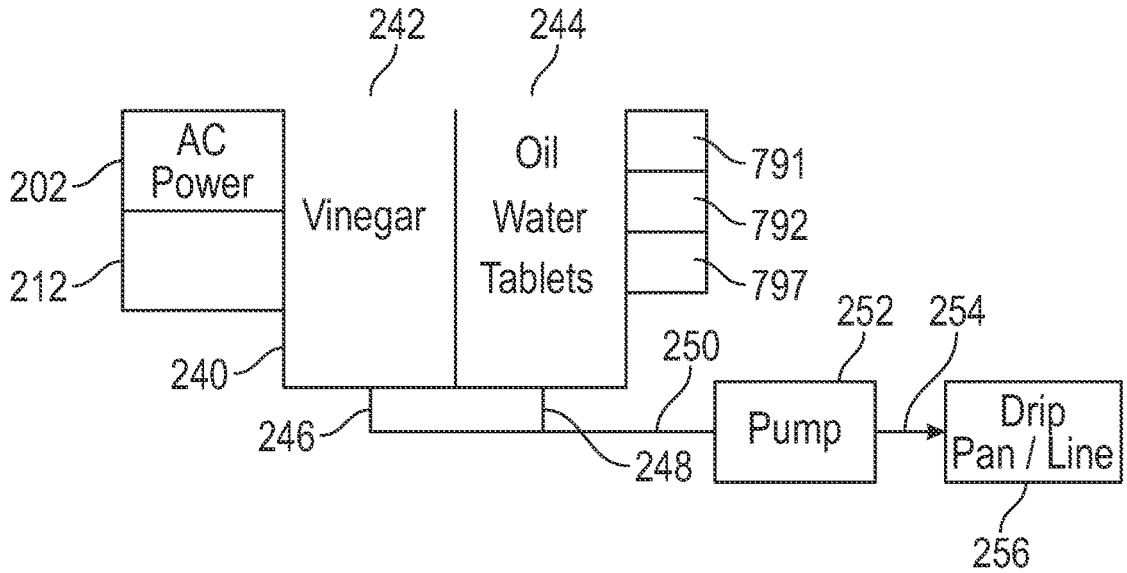
FIG. 2B is an illustration of a drip line device, according to one embodiment.

In FIG. 2B, an illustration of a drip line device is shown, according to one embodiment. In this example, the drip line device may include the power source 202, the controller 212, a reservoir 240, a first reservoir section 242, a second reservoir section 244, a first reservoir section line 246, a second reservoir section line 248, a pump input line 250, a pump 252, a pump exit line 254, a drip pan/line 254, a transceiver 791, a display 792, and/or a block diagram device 797.

The first reservoir section 242 may include any element 210 (e.g., water, sodium hydroxide, vinegar, chlorine, bleach, citric acid, sodium hypochlorite, ammonia, detergent, etc.) either in liquid and/or gaseous form. The second reservoir section 244 may include any element 210 (e.g., water, sodium hydroxide, vinegar, chlorine, bleach, citric acid, sodium hypochlorite, ammonia, detergent, etc.) in any form (e.g., liquid, gaseous, and/or solid). For example, vinegar solid tablets may be utilized and transported to the drip pan/line 256. In another example, a slurry of water, vinegar, and a bleach solid (e.g., small tablet) may be injected by the pump 252 into the drip pan/line 256 via the first reservoir section line 246 and second reservoir section line 248. The transceiver 791 may communicate to and from the drip line device to another device and/or a remote device (e.g., mobile phone, etc.). The display 792 may display the status of the drip line device, the status of any part of the total system (e.g., cartridge level, PH level of water in condensation line, condensation line characteristics, and/or any other information disclosed in this disclosure). The block diagram device 797 may be any device and/or module disclosed in FIG. 8.

In one example, the reservoir may hold a volume of 40 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure) in the first reservoir section 242. Further, the reservoir may hold a volume of 20 ounces of a lubrication element in the second reservoir section 244. In this example, the controller 212 may control the flow of the element 210 and the lubrication element based on time data. In this example, the controller 212 may send a signal to one or more release devices (discussed in various sections of this disclosure) to release 2 ounces of element 210 (e.g., 80% vinegar and 20% water) and 0.5 ounces of lubrication element into the pump input line 250, which then gets transported by the pump 525 every fourteen days to drip pan/line 256 at a flow rate of 1.25 ounces per second.

In another example, the reservoir may hold a volume of 50 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure) in the first reservoir section 242. Further, the reservoir may hold a volume of 50 ounces of sodium hydroxide in the second reservoir section 244. In this example, the controller 212 may control the flow of the first element (e.g., 50% vinegar and 50% water) and the sodium hydroxide based on time data. In this example, the controller 212 may send a signal to one or more release devices (discussed in various sections of this disclosure) to release 3 ounces of the first element and 3 ounces of sodium hydroxide into the pump input line 250, which then gets transported by the pump 525 every thirty days to drip pan/line 256 at a flow rate of 0.5 ounces per minute.

In another example, the reservoir may hold a volume of 26 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure) in solid form (e.g., tablets, powder, etc.). In this example, the controller 212 may control the dropping of a tablet or an amount of powder based on time data. In this example, the controller 212 may send a signal to one or more release devices (discussed in various sections of this disclosure) to release 0.5 ounces of the element in solid form every fourteen days to drip pan/line 256.

The one or more elements (e.g., water, sodium hydroxide, vinegar, chlorine, bleach, citric acid, sodium hypochlorite, ammonia, detergent, etc.) 210 either cleans out the condensation line and/or changes the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

Figure 3:
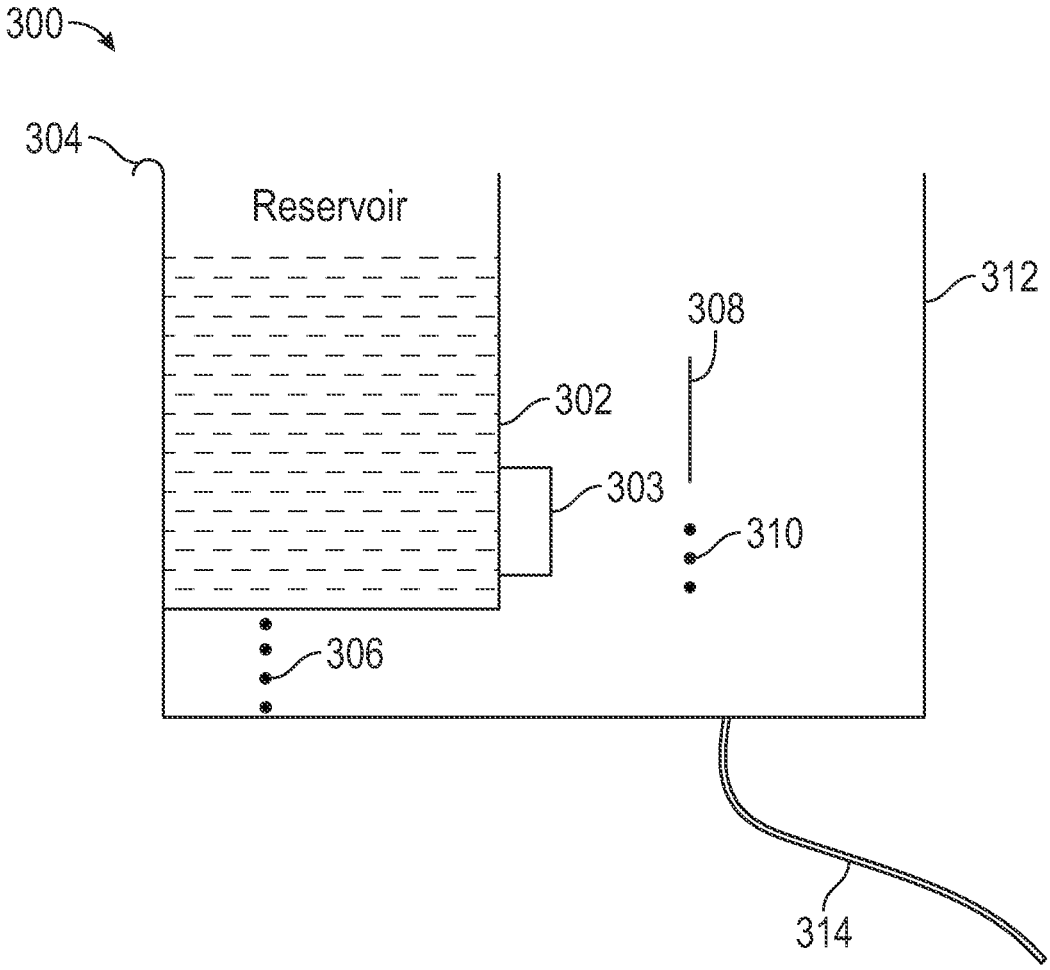
FIG. 3 is an illustration of a drip line device, according to one embodiment.

In FIG. 3, an illustration of a drip line device 300 is shown, according to one embodiment. The drip line device 300 may include a reservoir 302, a block diagram device 303, and/or an attachment device 304. In this example, a drip pan/line 312 may receive condensation 310 (e.g., water, etc.) from a condensation drain line 308 which may come from the evaporator coil and/or any other source of condensation. Further, in this example, an element (e.g., water, sodium hydroxide, vinegar, chlorine, bleach, citric acid, sodium hypochlorite, ammonia, detergent, etc.) from reservoir 302 may be gravity fed and/or delivered (via a pump and/or any other device from this disclosure) to the drip pan/line 312.

Figure 8:
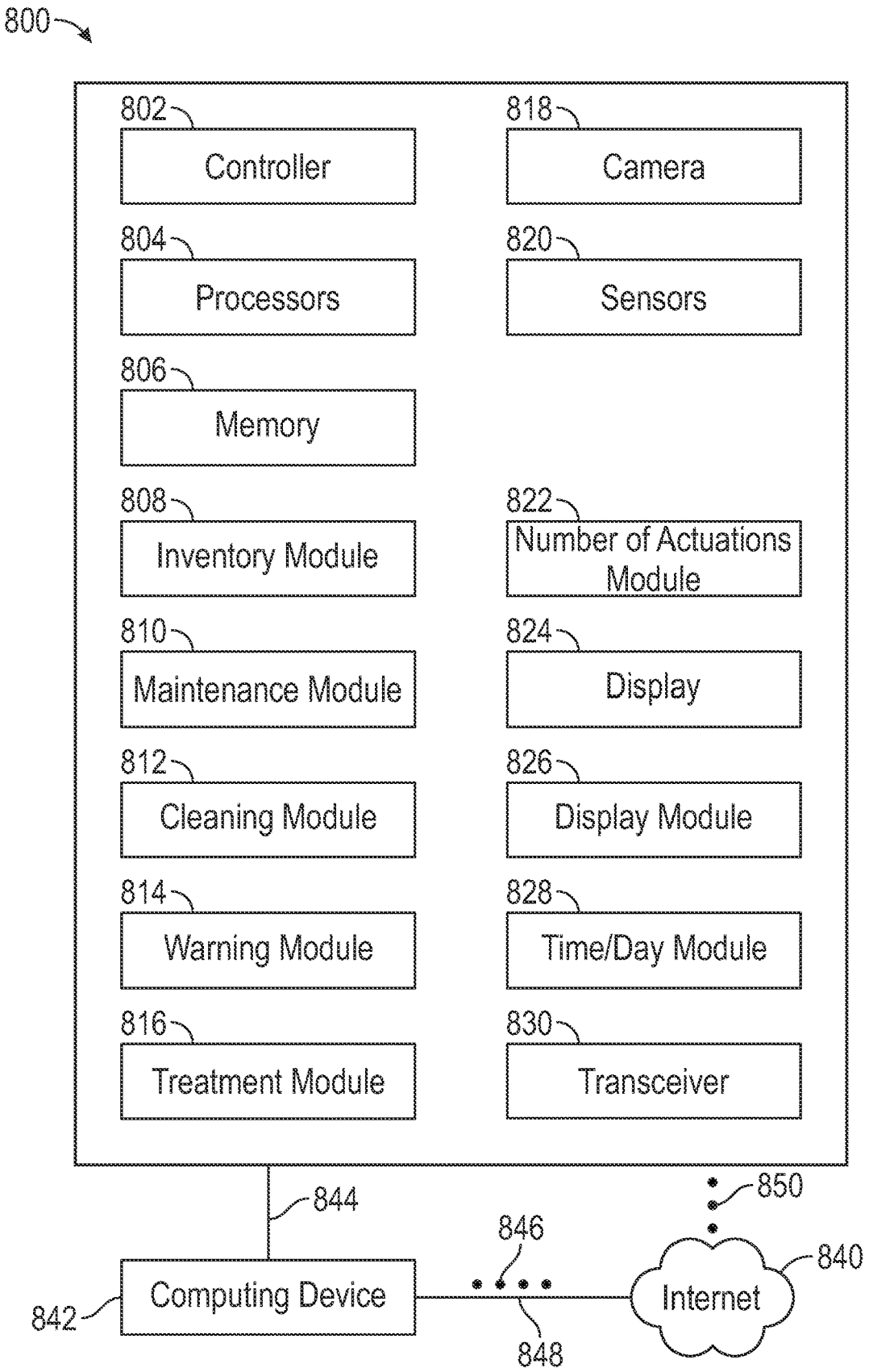
FIG. 8 is a block diagram of a system, according to one embodiment.

In this example, block diagram device 303 may be any device and/or module discussed in FIG. 8 and/or any other device and/or module discussed in this disclosure. The attachment device 304 may be a strap, clip, hook, nail, adhesive, Velcro, magnet, and/or any other attachment device to secure drip line device 300 to drip pan/line 312.

In one example, the reservoir may hold a volume of 60 ounces of element 210 (e.g., water, sodium hydroxide, vinegar, chlorine, bleach, citric acid, sodium hypochlorite, ammonia, detergent, etc.) and/or any other element disclosed in this disclosure). In one example, no controller 212 may be utilized because the element 210 is gravity fed into the drip pan/line 312 or 314 at a flow rate (range of 0.00011 ounces per minute to 0.00022 ounces per minute).

In another example, the reservoir may hold a volume of 60 ounces of element 210 (e.g., water, sodium hydroxide, vinegar, chlorine, bleach, citric acid, sodium hypochlorite, ammonia, detergent, etc.) and/or any other element disclosed in this disclosure). In one example, no controller 212 may be utilized because the element 210 is gravity fed into the drip pan/line 312 or 314 at a flow rate (range of 0.00023 ounces per minute to 0.001 ounces per minute).

In another example, the reservoir may hold a volume of 60 ounces of element 210 (e.g., water, sodium hydroxide, vinegar, chlorine, bleach, citric acid, sodium hypochlorite, ammonia, detergent, etc.) and/or any other element disclosed in this disclosure). In one example, no controller 212 may be utilized because the element 210 is gravity fed into the drip pan/line 312 or 314 at a flow rate (range of 0.001 ounces per minute to 0.01 ounces per minute).

In another example, the reservoir may hold a volume of 100 ounces of element 210 (e.g., water, sodium hydroxide, vinegar, chlorine, bleach, citric acid, sodium hypochlorite, ammonia, detergent, etc.) and/or any other element disclosed in this disclosure). In one example, no controller 212 may be utilized because the element 210 is gravity fed into the drip pan/line 312 or 314 at a flow rate (range of 0.001 ounces per minute to 0.01 ounces per minute).

The one or more elements (e.g., water, sodium hydroxide, vinegar, chlorine, bleach, citric acid, sodium hypochlorite, ammonia, detergent, etc.) 210 either cleans out the condensation line and/or changes the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

In another example, a replacement drip pan or a drip pan cover may replace and/or cover an existing drip pan. The replacement drip pan or drip pan cover may be made of a non-corrosive material to avoid any corrosion issues.

Figure 4A:
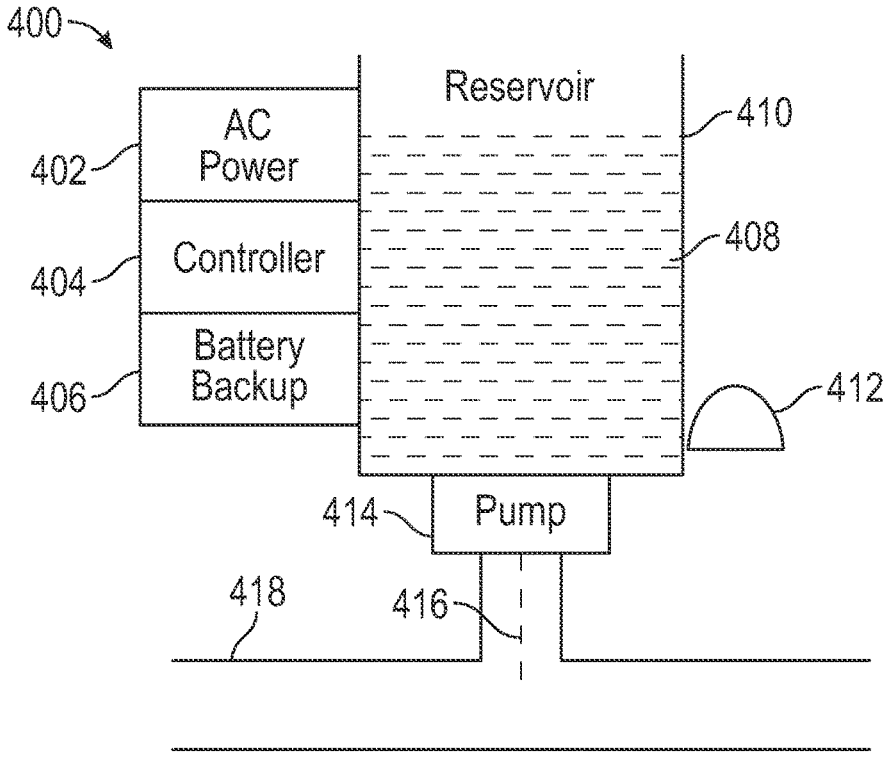
FIG. 4A is an illustration of a drip line device, according to one embodiment.

In FIG. 4A, an illustration of a drip line device 400 is shown, according to one embodiment. The drip line device 400 may include a power source 402, a controller 404, a backup power source 406, a reservoir 410, an element (e.g., water, sodium hydroxide, vinegar, chlorine, bleach, citric acid, sodium hypochlorite, ammonia, detergent, etc.) in the reservoir 410, a cap 412, and/or a pump 414. In this example, drip line device 400 is placed over an entrance to a condensation line 418 (See FIG. 1C), which allows for a delivered element 416 (e.g., water, sodium hydroxide, vinegar, chlorine, bleach, citric acid, sodium hypochlorite, ammonia, detergent, etc.) to be delivered from the reservoir 410 to the condensation line.

In this example, the pump 414 is located at the bottom of the reservoir 410 and draws one or more elements out of the reservoir 410 and transports the one or more drawn elements to the condensation line 418.

In one example, the reservoir 410 may hold a volume of 25 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 404 may control the flow of the element 408 based on time data. In this example, the controller 404 may send a signal to one or more release devices (discussed in various sections of this disclosure) to release 1 ounce of element 408 (e.g., 100% vinegar) via the pump 414 every fourteen days to condensation line 418 at a flow rate of 0.25 ounces per minute (and/or 1 ounce per second, and/or 0.5 ounces per second). A released element 416 is shown entering the condensation line 418 in FIG. 4A.

In another example, the reservoir 410 may hold a volume of 12 ounces of element 210 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 404 may control the flow of the element 408 based on time data. In this example, the controller 404 may send a signal to one or more release devices (discussed in various sections of this disclosure) to release 1 ounce of element 408 (e.g., 100% vinegar) via the pump 414 every thirty days to condensation line 418 at a flow rate of 0.5 ounces per minute. The released element 416 is shown entering the condensation line 418 in FIG. 4A.

The one or more elements (e.g., water, sodium hydroxide, vinegar, chlorine, bleach, citric acid, sodium hypochlorite, ammonia, detergent, etc.) 210 either cleans out the condensation line and/or changes the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

Figure 4B:
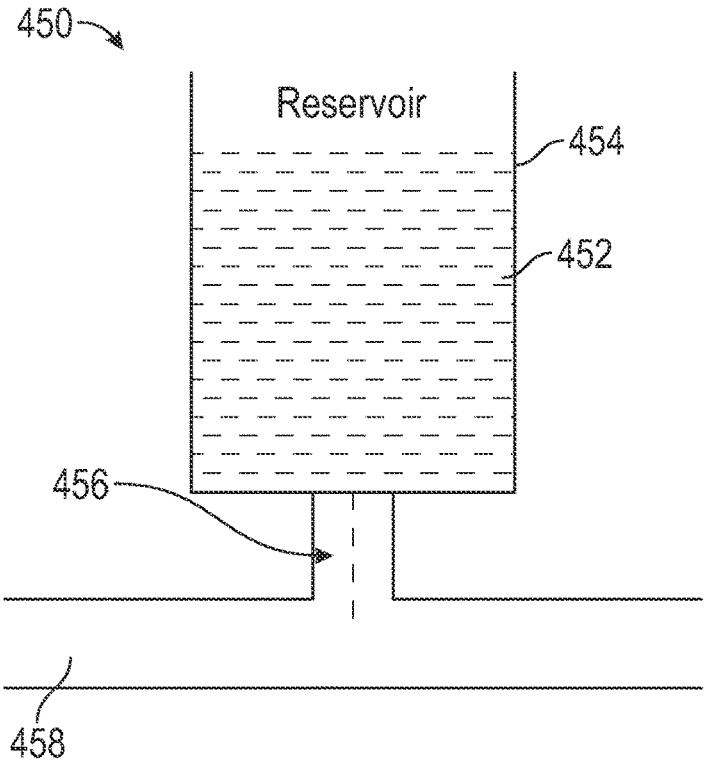
FIG. 4B is another illustration of a drip line device, according to one embodiment.

In FIG. 4B, another illustration of a drip line device 450 is shown, according to one embodiment. Drip line device 450 may include an element 452 (e.g., water, sodium hydroxide, vinegar, chlorine, bleach, citric acid, sodium hypochlorite, ammonia, detergent, etc.) located inside of a reservoir 454. In this example, a delivered element 456 (e.g., water, sodium hydroxide, vinegar, chlorine, bleach, citric acid, sodium hypochlorite, ammonia, detergent, etc.) is fed by gravity to a condensation line 458.

In this example, there is no pump, power supply, and/or controller. In this example, the one or more elements 452 are transported out of the reservoir 454 via gravity. In this example, a flow rate may be determined by one or more orifices and/or any other flow control device in this document.

In one example, the reservoir 454 may hold a volume of 18 ounces of element 452 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the flow rate is determined by one or more flow controls (e.g., orifices, etc.). In this example, one or more flow controls may release 3 ounces of element 452 (e.g., 10-20% vinegar) on a 30 day schedule to condensation line 458 at a flow rate of 0.1 ounces per day. A released element 456 is shown entering the condensation line 458 in FIG. 4B.

In one example, the reservoir 454 may hold a volume of 36 ounces of element 452 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the flow rate is determined by one or more flow controls (e.g., orifices, etc.). In this example, one or more flow controls may release 3 ounces of element 452 (e.g., 10-20% vinegar) on a 30 day schedule to condensation line 458 at a flow rate of 0.1 ounces per day. A released element 456 is shown entering the condensation line 458 in FIG. 4B.

In one example, the reservoir 454 may hold a volume of 72 ounces of element 452 (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the flow rate is determined by one or more flow controls (e.g., orifices, etc.). In this example, one or more flow controls may release 6 ounces of element 452 (e.g., 10-20% vinegar) on a 30 day schedule to condensation line 458 at a flow rate of 0.2 ounces per day. A released element 456 is shown entering the condensation line 458 in FIG. 4B.

In every example disclosed in this disclosure, the flow rate may be any number between 0.05 ounces, 0.06 ounces, 0.07 ounces, 0.08 ounces, 0.09 ounces, 0.1 ounces, . . . , 2.9 ounces, 3.0 ounces, 3.1 ounces, . . . 5.7 ounces, 5.8 ounces, 5.0 ounces, and 6.0 ounces a day. In every example disclosed in this disclosure, the flow rate may be any number between 0.0001 ounces, 0.0002 ounces, 0.0003 ounces, 0.0004 ounces, 0.0005 ounces, 0.0006 ounces, . . . , 0.01 ounces, 0.011 ounces, 0.012 ounces, . . . 0.5 ounces, 0.51 ounces, . . . , 3.9 ounces, and 4.0 ounces a second. In every example disclosed in this disclosure, the flow rate may be any number between 0.0001 ounces, 0.0002 ounces, 0.0003 ounces, 0.0004 ounces, 0.0005 ounces, 0.0006 ounces, . . . , 0.01 ounces, 0.011 ounces, 0.012 ounces, . . . 0.5 ounces, 0.51 ounces, . . . , 3.9 ounces, and 4.0 ounces a minute. In every example disclosed in this disclosure, the flow rate may be any number between 0.0001 ounces, 0.0002 ounces, 0.0003 ounces, 0.0004 ounces, 0.0005 ounces, 0.0006 ounces, . . . , 0.01 ounces, 0.011 ounces, 0.012 ounces, . . . 0.5 ounces, 0.51 ounces, . . . , 3.9 ounces, 4.0 ounces, . . . , 5.9 ounces, and 6.0 ounces per hour.

The one or more elements (e.g., water, sodium hydroxide, vinegar, chlorine, bleach, citric acid, sodium hypochlorite, ammonia, detergent, etc.) 210 either cleans out the condensation line and/or changes the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

Figure 5A:
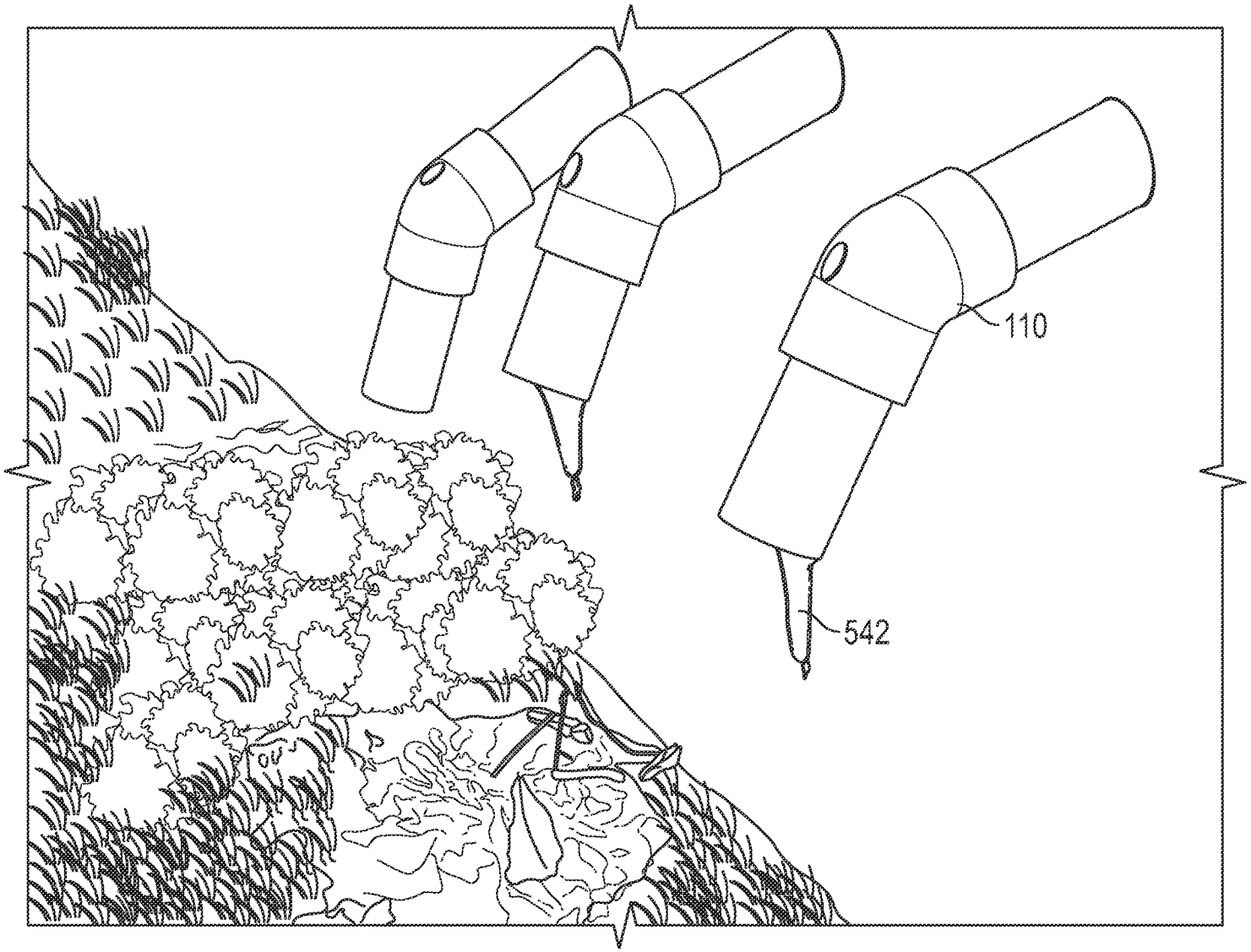
FIG. 5A is an illustration of sludge, bacteria growth, or another element blocking the flow of fluids out of an HVAC system, according to one embodiment.

In FIG. 5A, an illustration of sludge, bacteria growth, or another element blocking the flow of fluids out of an HVAC system is shown, according to one embodiment. In this example, an outside portion of a condensation line shows a line blocking element (e.g., sludge, bacteria growth, etc.) located on the outlet of the outside portion of the condensation line. This line blocking element may be in any position and/or location of the condensation line.

Figure 5B:
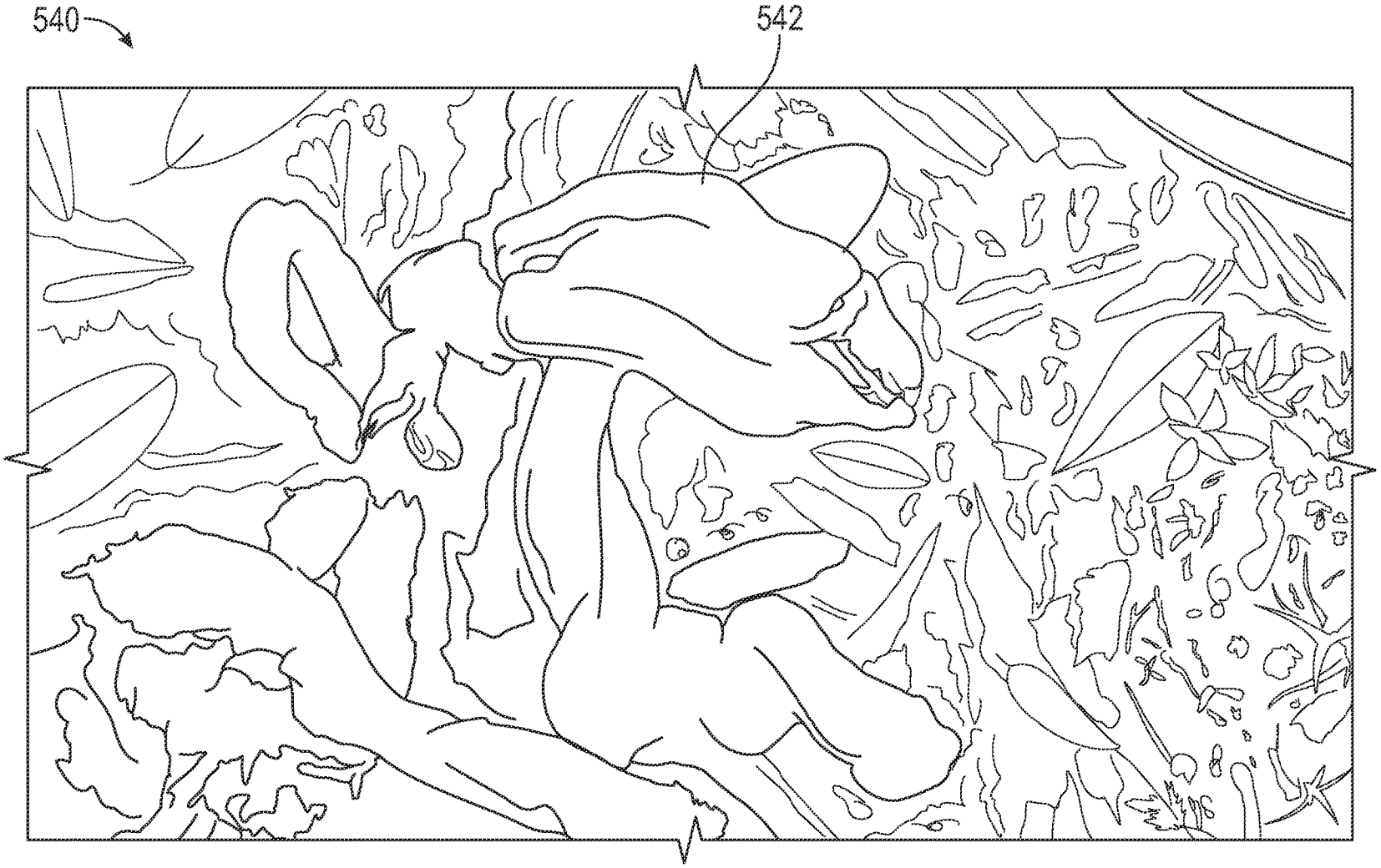
FIG. 5B is an illustration of sludge, bacteria growth, or another blocking element after removal from the HVAC system, according to one embodiment.

In FIG. 5B, an illustration of sludge, bacteria growth, or another blocking element after removal from the HVAC system is shown, according to one embodiment. In this example, a blocking element (e.g., sludge, bacteria growth, etc.) was removed from the condensation line. As shown in this example, the blocking element can be of significant length relative to the condensation line's length.

Figure 6:
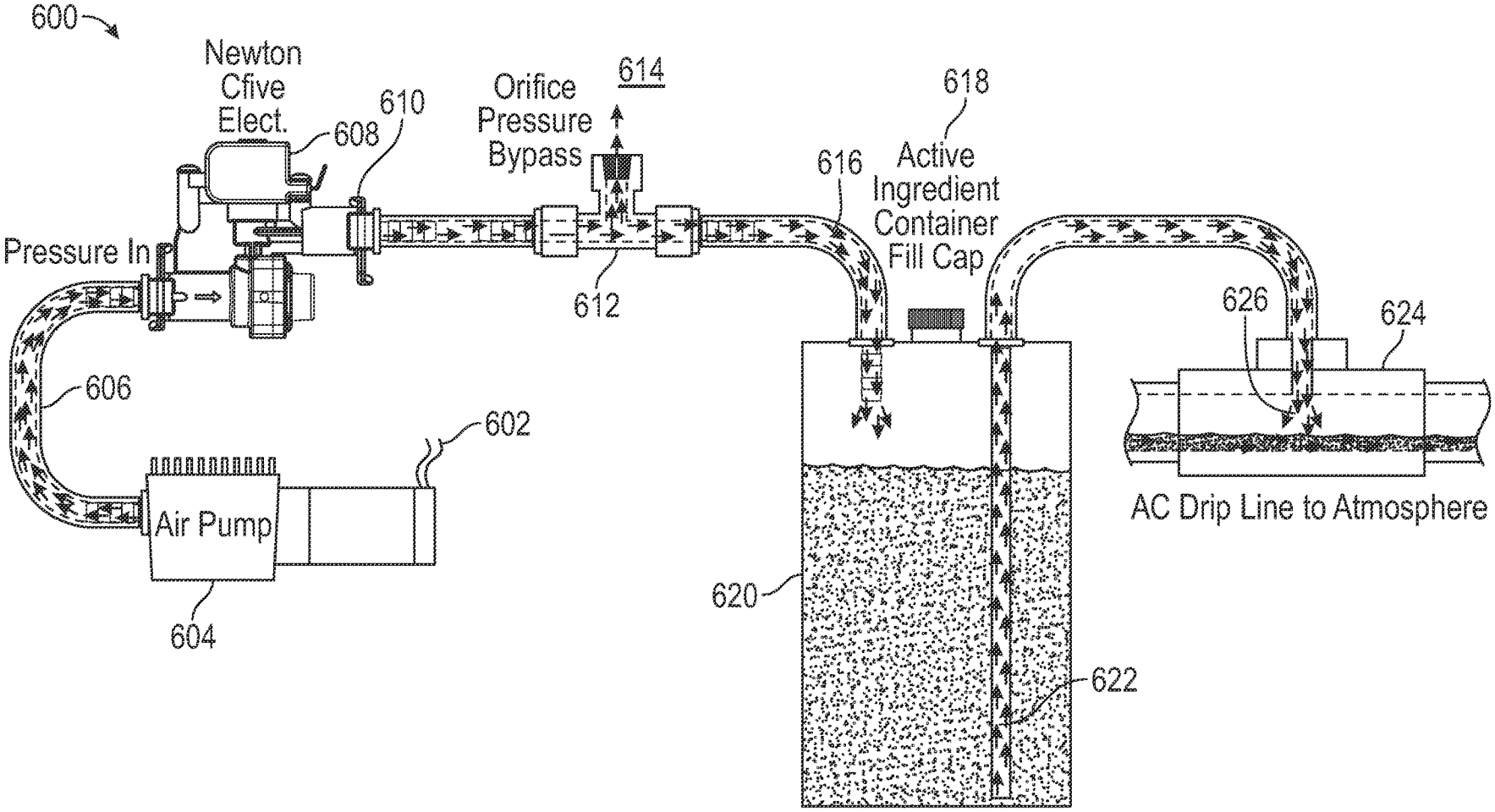
FIG. 6 is another illustration of a drip line device, according to one embodiment.

In FIG. 6, another illustration of a drip line device 600 is shown, according to one embodiment. Drip line device 600 may include a gas source 602 (e.g., air, etc.), a gas pump 604, a pump outlet line 606, a pressure control valve 608, a connection device 610, an orifice 612, an orifice pressure bypass 614, a reservoir inlet line 616, a filler cap 618, a reservoir 620 with an element (e.g., water, sodium hydroxide, vinegar, chlorine, bleach, citric acid, sodium hypochlorite, ammonia, detergent, etc.), and/or a reservoir outlet line 622. In this example, a delivered element 626 (e.g., water, sodium hydroxide, vinegar, chlorine, bleach, citric acid, sodium hypochlorite, ammonia, detergent, etc.) is fed into an HVAC drip line to atmosphere line 624.

In this example, the gas pump 604 utilizes a gas (e.g. air) to generate pressure which is controlled by the pressure control valve 608 to push one or more elements (e.g., water, sodium hydroxide, vinegar, chlorine, bleach, citric acid, sodium hypochlorite, ammonia, detergent, etc.) out of the reservoir 620 to the HVAC drip line to atmosphere line 624. In this example, the orifice pressure bypass 612 is utilized as a pressure release device. In addition, the filler cap 618 allows for the refilling of the reservoir 620 with one or more elements.

In one example, the reservoir 620 may hold a volume of 35 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, a controller may control the flow of the element based on time data. In this example, the controller may send a signal to one or more release devices (discussed in various sections of this disclosure) to release 2 ounces of element (e.g., 100% vinegar) via the gas pump 604 every twenty-one days to the HVAC drip line to atmosphere line 624 at a flow rate of 0.75 ounces per minute. A delivered element 626 is shown entering the condensation line 624 in FIG. 6.

In another example, the reservoir 620 may hold a volume of 64 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller may control the flow of the element based on time data. In this example, the controller may send a signal to one or more release devices (discussed in various sections of this disclosure) to release 3 ounces of element 408 (e.g., 30% vinegar) via the gas pump 604 every twenty-one days to the HVAC drip line to atmosphere line 624 at a flow rate of 0.75 ounces per minute. A delivered element 626 is shown entering the condensation line 624 in FIG. 6.

The one or more elements (e.g., water, sodium hydroxide, vinegar, chlorine, bleach, citric acid, sodium hypochlorite, ammonia, detergent, etc.) either clean out the condensation line and/or change the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

Figure 7A:
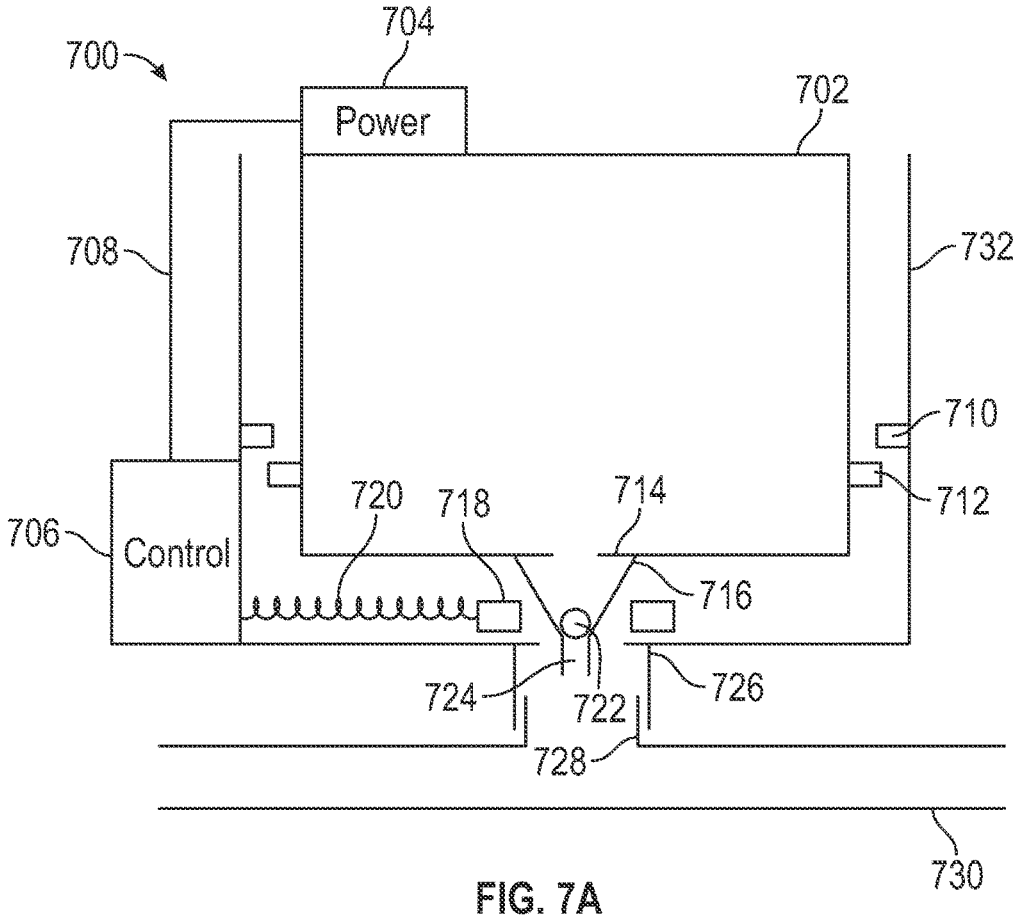
FIG. 7A is an illustration of a drip line device, according to one embodiment.

In FIG. 7A, an illustration of a drip line device 700 is shown, according to one embodiment. Drip line device 700 may include a reservoir 702 (or a snap in cartridge), a power source 704, a controller 706, a power supply connection 708, a first snap-in-place device 710, a second snap-in-place device 712, a ledge 714, a funnel 716, one or more magnets 718, a power/control line 720, a ball 722, a head pressure line 724, a connection from the drip line device to condensation line element 726, and/or a drip line device housing 732. In this example, a condensation line 730 has a condensation line entry point 728.

Reservoir 702 (or a snap in cartridge) may contain one or more elements (e.g., water, sodium hydroxide, vinegar, chlorine, bleach, citric acid, sodium hypochlorite, ammonia, detergent, etc.). The power source 704 may be any power source discussed in this disclosure. The controller 706 may be any controller discussed in this disclosure.

In this example, the drip line device housing 732 may be coupled to the controller 706. The controller 706 may be coupled to the power supply 704 via the power supply connection 708. In addition, the drip line device housing 732 may have the first snap-in-place device 710 which connects to the second snap-in-place device 712 to connect the reservoir 702 (and/or cartridge) to the drip line device housing 732. The first snap-in-place device 710 and the second snap-in-place device 712 allows for easy connecting and disconnecting of the reservoir 702 to and from the drip line device housing 732. Therefore, when the reservoir 702 needs to be replaced, the replacement procedure is uncomplicated.

In this example, the controller 706 is coupled to one or more magnets 718 via power/control line 720. Further, the reservoir 702 may include the ledge 714, the funnel 716, the ball 722, and/or the head pressure line 724. Whereas, the drip line device housing 732 may include the one or more magnets 718 and the power/control line 720. In addition, the power supply 704 may be included and/or coupled to the reservoir 702.

In this example, the ball 722 is made of ferromagnetic material. The ball 722 may also be coated in a non-corrosive material. This non-corrosive material allows the ball 722 to resist corrosion while allowing the one or more magnets 718 to move the ball 722. In this example, the ledge 714 may restrict the ball 722 from being able to move outside of the area covered by the funnel 716.

In one example, the reservoir 702 may hold a volume of 12 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 706 may control the flow of the element based on time data. In this example, the controller 706 may send a signal to one or more release devices (discussed in various sections of this disclosure) to release 1 ounce of element (e.g., 100% vinegar) via turning on the one or more magnets 718 to move ball 722 which allows for a flow stream through the head pressure line 724 to the condensation line 728. The controller may initiate the flow stream of 1 ounce every thirty days at a flow rate of 1.0 ounce per minute.

In this example, the ball 722 is position over an opening and stops the flow of any of the one or more elements from leaving the reservoir 702. The ball 722 is held in place by the force of the one or more elements. In this example, the one or more magnets 718 exert a force on the ball 722 to move the ball 722 to the right and/or to the left of the opening, which allows for flow of the one or more elements out of the reservoir 702 (and/or cartridge). In one example, when the magnet(s) are turned off, the ball(s) move back to block the opening to stop the flow of one or more elements based on the force of the one or more elements pushing the ball(s) towards the opening(s).

In one example, the reservoir 702 may hold a volume of 10 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 706 may control the flow of the element based on time data. In this example, the controller 706 may send a signal to one or more release devices (discussed in various sections of this disclosure) to release 1.666 ounce of element (e.g., 90% vinegar) via turning on the one or more magnets 718 to move ball 722 which allows for a flow stream through the head pressure line 724 to the condensation line 730. The controller may initiate the flow stream of 1.666 ounces every thirty days at a flow rate of 0.8 ounces per minute.

In this example, the connection from the drip line device to condensation line element 726 couples the drip line device housing 732 to the condensation line entry point 728.

The one or more elements (e.g., water, sodium hydroxide, vinegar, chlorine, bleach, citric acid, sodium hypochlorite, ammonia, detergent, etc.) either clean out the condensation line and/or change the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

Figure 7B:
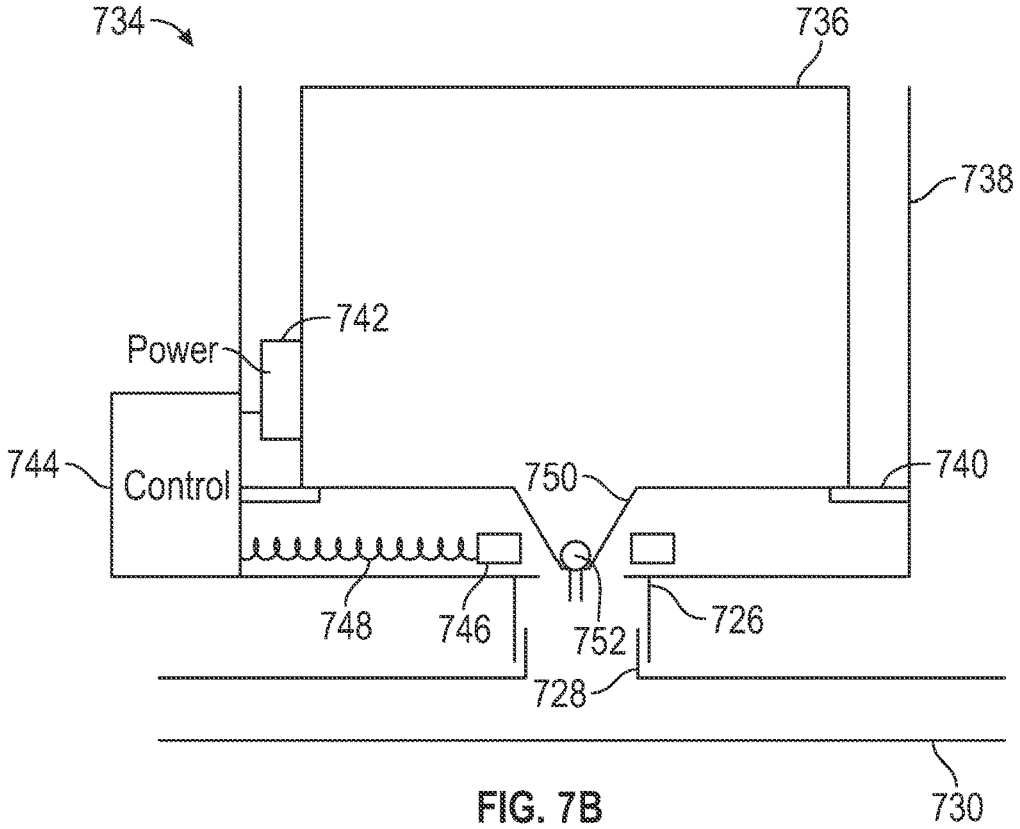
FIG. 7B is another illustration of a drip line device, according to one embodiment.

In FIG. 7B, another illustration of a drip line device 734 is shown, according to one embodiment. Drip line device 734 may include a reservoir 736, a drip line device housing 738, one or more holding devices 740, a power supply 742, a controller 744, one or more magnetics 746, a control/power line 748, a funnel 750, and/or a ball 752.

In this example, the drip line device housing 738 may be coupled to the controller 744. The controller 744 may be coupled to the power supply 742 via the power supply connection. In addition, the drip line device housing 738 may have one or more holding devices 740 which connect the reservoir 736 (and/or cartridge) to the drip line device housing 738. The one or more holding devices 740 allow for easy connecting and disconnecting of the reservoir 736 to and from the drip line device housing 738. Therefore, when the reservoir 736 needs to be replaced, the replacement procedure is uncomplicated.

In this example, the controller 744 is coupled to one or more magnets 746 via power/control line 748. Further, the reservoir 736 may include the a funnel 750, the ball 752, and/or the head pressure line. Whereas, the drip line device housing 738 may include the one or more magnets 746 and the power/control line 748. In addition, the power supply 742 may be included and/or coupled to the reservoir 736.

In this example, the ball 752 is made of ferromagnetic material. The ball 752 may also be coated in a non-corrosive material. This non-corrosive material allows the ball 752 to resist corrosion while allowing the one or more magnets 746 to move the ball 752. In this example, there is no ledge to restrict the ball 752 movement outside of the area covered by the funnel 750.

In one example, the reservoir 736 may hold a volume of 8 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 744 may control the flow of the element based on time data. In this example, the controller 744 may send a signal to one or more release devices (discussed in various sections of this disclosure) to release 0.5 ounces of element (e.g., 100% vinegar) via turning on the one or more magnets 746 to move ball 752 which allows for a flow stream through the head pressure line to the condensation line 730. The controller may initiate the flow stream of 0.5 ounce every twenty-one days at a flow rate of 0.5 ounces per minute.

In this example, the ball 752 is position over an opening and stops the flow of any of the one or more elements from leaving the reservoir 736. The ball 752 is held in place by the force of the one or more elements. In this example, the one or more magnets 746 exert a force on the ball 752 to move the ball 752 to the right and/or to the left of the opening, which allows for flow of the one or more elements out of the reservoir 736 (and/or cartridge). In one example, when the magnet(s) are turned off, the ball(s) move back to block the opening to stop the flow of one or more elements based on the force of the one or more elements pushing the ball(s) towards the opening(s).

In one example, the reservoir 736 may hold a volume of 22 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 744 may control the flow of the element based on time data. In this example, the controller 744 may send a signal to one or more release devices (discussed in various sections of this disclosure) to release 1.8333 ounces of element (e.g., 100% vinegar) via turning on the one or more magnets 746 to move ball 752 which allows for a flow stream through the head pressure line to the condensation line 730. The controller may initiate the flow stream of 1.8333 ounce every thirty days at a flow rate of 0.5 ounces per second.

In this example, the connection from the drip line device to condensation line element 726 couples the drip line device housing 732 to the condensation line entry point 728.

The one or more elements (e.g., water, sodium hydroxide, vinegar, chlorine, bleach, citric acid, sodium hypochlorite, ammonia, detergent, etc.) either clean out the condensation line and/or change the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

Figure 7C:
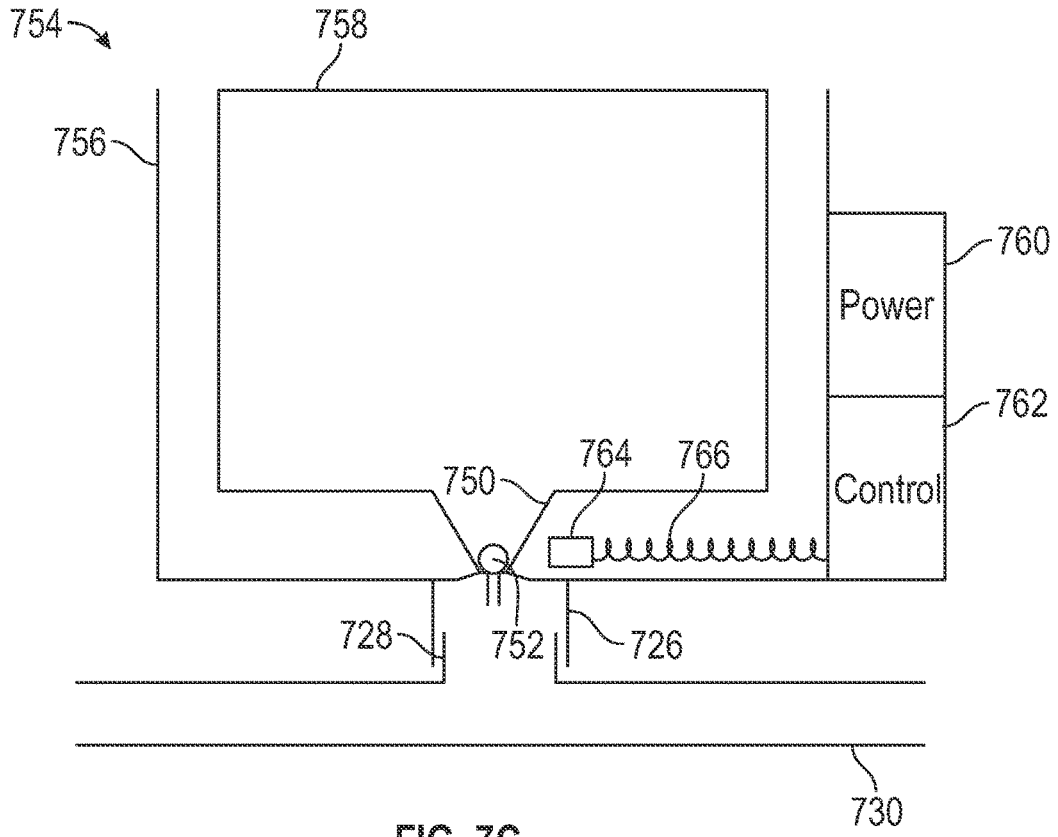
FIG. 7C is another illustration of a drip line device, according to one embodiment.

In FIG. 7C, another illustration of a drip line device 754 is shown, according to one embodiment. Drip line device 754 may include a drip line device housing 756, a reservoir 758, a power supply 760, a controller 762, a magnetic 764, a control/power line 766, the funnel 750, and/or the ball 752.

In this example, the drip line device housing 756 may be coupled to the controller 762 and the power supply 764. The controller 762 may be coupled to the power supply 762 via the power supply connection. In addition, the drip line device housing 756 may have one or more holding devices which connect the reservoir 758 (and/or cartridge) to the drip line device housing 756.

In this example, the controller 762 is coupled to a magnet 764 via power/control line 766. Further, the reservoir 758 may include the funnel 750 and the ball 752, and/or the head pressure line. Whereas, the drip line device housing 756 may include the magnet 764 and the power/control line 766.

In this example, the ball 752 is made of ferromagnetic material. The ball 752 may also be coated in a non-corrosive material. This non-corrosive material allows the ball 752 to resist corrosion while allowing the magnet 764 to move the ball 752. In this example, there is no ledge to restrict the ball 752 movement outside of the area covered by the funnel 750.

In one example, the reservoir 758 may hold a volume of 25 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 762 may control the flow of the element based on time data. In this example, the controller 762 may send a signal to one or more release devices (discussed in various sections of this disclosure) to release 0.52 ounces of element (e.g., 100% vinegar) via turning on the magnet 764 to move ball 752 which allows for a flow stream through the head pressure line to the condensation line 730. The controller 762 may initiate the flow stream of 0.52 ounces every seven days at a flow rate of 0.5 ounces per minute.

In this example, the ball 752 is position over an opening and stops the flow of any of the one or more elements from leaving the reservoir 758. The ball 752 is held in place by the force of the one or more elements. In this example, the magnet 764 exert a force on the ball 752 to move the ball 752 to the right and/or to the left of the opening, which allows for flow of the one or more elements out of the reservoir 758 (and/or cartridge). In one example, when the magnet(s) are turned off, the ball(s) move back to block the opening to stop the flow of one or more elements based on the force of the one or more elements pushing the ball(s) towards the opening(s).

In one example, the reservoir 758 may hold a volume of 21 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 762 may control the flow of the element based on time data. In this example, the controller 762 may send a signal to one or more release devices (discussed in various sections of this disclosure) to release 0.0625 ounces of element (e.g., 100% vinegar) (or 0.0583 ounces of element) via turning on the magnet 764 to move ball 752 which allows for a flow stream through the head pressure line to the condensation line 730. The controller may initiate the flow stream of 0.0625 ounces (or 0.0583 ounces) every day at a flow rate of 0.00005 ounces per second.

In this example, the connection from the drip line device to condensation line element 726 couples the drip line device housing 732 to the condensation line entry point 728.

The one or more elements (e.g., water, sodium hydroxide, vinegar, chlorine, bleach, citric acid, sodium hypochlorite, ammonia, detergent, etc.) either clean out the condensation line and/or change the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

Figure 7D:
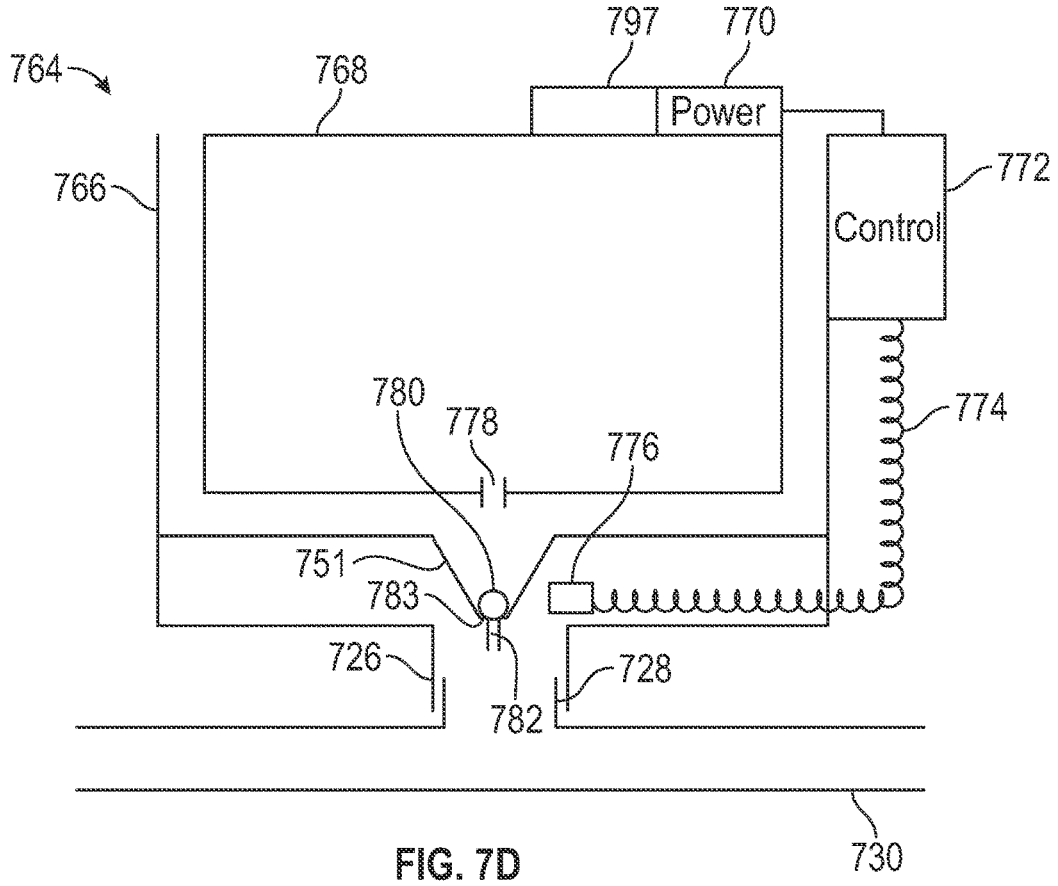
FIG. 7D is another illustration of a drip line device, according to one embodiment.

In FIG. 7D, another illustration of a drip line device 764 is shown, according to one embodiment. Drip line device 764 may include a housing 766, a reservoir 768, a power supply 770, a controller 772, a control/power line 744, a magnet 776, an outlet for the reservoir 778, a ball 780, an outlet of the drip line device 782, a shelf 783 where the ball 780 can move back and forth, and/or a block diagram device 797.

In this example, the drip line device housing 766 may be coupled to the controller 772. The controller 772 may be coupled to the power supply 770 via the power supply connection. In addition, the drip line device housing 766 may have one or more holding devices which connect the reservoir 768 (and/or cartridge) to the drip line device housing 766.

In this example, the controller 772 is coupled to a magnet 776 via power/control line 774. Further, the reservoir 768 may include an outlet area 778 and one or more block diagram elements 797. Whereas, the drip line device housing 766 may include the magnet 776, the ball 780, the shelf 783, the head pressure line 782, and a funnel 751.

In this example, the ball 780 is made of ferromagnetic material. The ball 780 may also be coated in a non-corrosive material. This non-corrosive material allows the ball 780 to resist corrosion while allowing the magnet 776 to move the ball 780. In this example, there is no ledge to restrict the ball 780 movement outside of the area covered by the funnel 751.

In one example, the reservoir 768 may hold a volume of 28 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 772 may control the flow of the element based on time data. In this example, the controller 772 may send a signal to one or more release devices (discussed in various sections of this disclosure) to release 0.5833 ounces of element (e.g., 90% vinegar) (or 0.07777 ounces) via turning on the magnet 776 to move ball 780 which allows for a flow stream through the outlet area of the reservoir 768 to the funnel 751 of the drip line device housing 766 to the condensation line 730. The controller 762 may initiate the flow stream of 0.5833 ounces (or 0.07777 ounces) every seven days at a flow rate of 0.1 ounces per minute (or per second).

In this example, the ball 780 is position over an opening and stops the flow of any of the one or more elements from leaving the drip line housing device 766. The ball 780 is held in place by the force of the one or more elements. In this example, the magnet 766 exert a force on the ball 780 to move the ball 780 to the right and/or to the left of the opening on the shelf 783, which allows for flow of the one or more elements out of the reservoir 768 (and/or cartridge) and/or the drip line housing device 766. In one example, when the magnet(s) are turned off, the ball(s) move back to block the opening to stop the flow of one or more elements based on the force of the one or more elements pushing the ball(s) towards the opening(s).

In one example, the reservoir 768 may hold a volume of 32 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 772 may control the flow of the element based on time data and/or sensor data and/or any other data disclosed in this document. In this example, the controller 772 may send a signal to one or more release devices (discussed in various sections of this disclosure) to release 1.333 ounces of element (e.g., 5-30% vinegar) via turning on the magnet 776 to move ball 780 which allows for a flow stream through the outlet area of the reservoir 768 to the funnel 751 of the drip line device housing 766 to the condensation line 730. The controller 762 may initiate the flow stream of 1.333 ounces every seven days at a flow rate of 0.05 ounces per minute.

In this example, the connection from the drip line device to condensation line element 726 couples the drip line device housing 732 to the condensation line entry point 728.

The one or more elements (e.g., water, sodium hydroxide, vinegar, chlorine, bleach, citric acid, sodium hypochlorite, ammonia, detergent, etc.) either clean out the condensation line and/or change the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

Figure 7E:
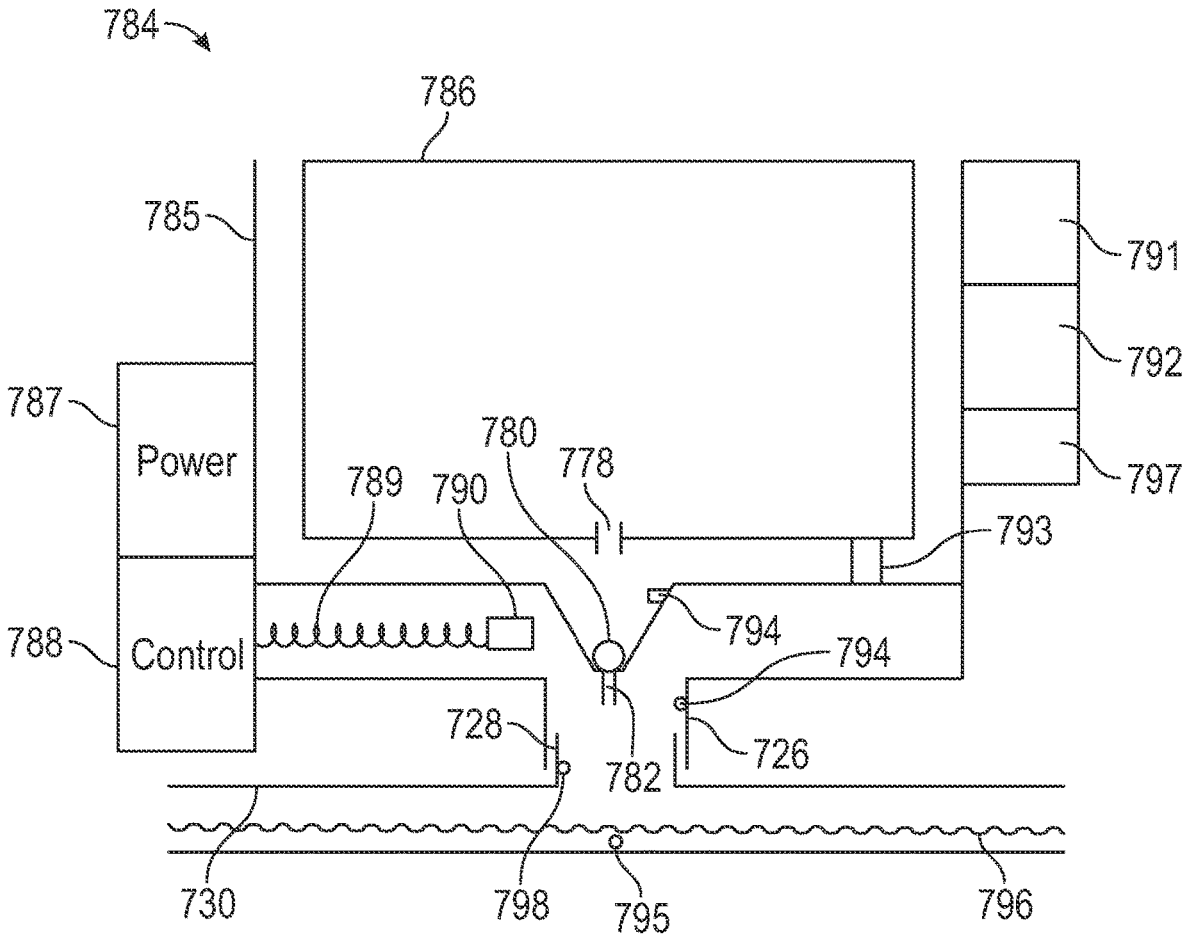
FIG. 7E is another illustration of a drip line device, according to one embodiment.

In FIG. 7E, another illustration of a drip line device 784 is shown, according to one embodiment. Drip line device 784 may include a housing 785, a reservoir 786, a power source 787, a controller 788, a control/power line 789 to a magnet 790, a transceiver 791, a display 792, a cartridge sensor 793, one or more flow sensors 794, a PH sensor 795, a block diagram device 797, and/or one or more cameras 798. In this example, a condensation stream 796 is shown in the condensation line 730. Further, the drip line device 784 may include a cartridge outlet area 778, the ball 780, and/or the outlet of the drip line device 782. Further, the shelf 783 is present to allow the ball 780 to move which allows one or more elements from the reservoir 786 to be delivered to the condensation line 730.

In this example, the drip line device housing 785 may be coupled to the power source 787, the controller 788, the transceiver 791, the display 792, one or more flow sensors 794, and block diagram device 797. The controller 788 may be coupled to the power supply 787 via the power supply connection. In addition, the drip line device housing 785 may have one or more holding devices which connect the reservoir 786 (and/or cartridge) to the drip line device housing 785. In addition, one or more cartridge sensors 793 (e.g., reservoir sensor) may be attached to the reservoir 786 and/or the drip line device housing 785. The one or more cartridge sensors 793 may be a weight sensor to determine weight data relating to the reservoir 786 (and/or cartridge).

In this example, the controller 788 is coupled to a magnet 790 via the power/control line 789. Further, the reservoir 786 may include the outlet area 778. Whereas, the drip line device housing 785 may include the magnet 790, the ball 780, the shelf 783, the head pressure line 782, and the funnel 751 (See FIG. 7D).

In this example, the ball 780 is made of ferromagnetic material. The ball 780 may also be coated in a non-corrosive material. This non-corrosive material allows the ball 780 to resist corrosion while allowing the magnet 790 to move the ball 780. In this example, there is no ledge to restrict the ball 780 movement outside of the area covered by the funnel 751. In addition, a flow sensor 794 may be located on the funnel 751. The flow sensor 794 may be configured to measure a flow rate out of the reservoir 786.

In another example, a flow sensor 794 located below the head pressure line 782 may be configured to measure a flow rate out of the drip line device housing 785. Further, the visual aid device 798 may be located below the head pressure line 782. The visual aid device 798 may be configured to provide images from the condensation flow stream, the condensation line 730, the head pressure line 782, the drip line device housing 785, and/or the reservoir 786. In addition, the PH sensor 795 may be located in the condensation line 730 and configured to transmit PH data relating to a condensation stream 796 to the drip line device and/or any other device.

In one example, the reservoir 786 may hold a volume of 12 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 788 may control the flow of the element based on time data, sensor data, imaging data, weight data, PH data, condensation stream data, and/or any other data disclosed in this disclosure. In this example, the controller 788 may send a signal to one or more release devices (discussed in various sections of this disclosure) to release 2.0 ounces (or 1.0 ounce) of element (e.g., 80-100% vinegar) via turning on the magnet 790 to move ball 780 which allows for a flow stream through the outlet area 778 of the reservoir 786 to the funnel 751 of the drip line device housing 785 to the condensation line 730. The controller 788 may initiate the flow stream of 2.0 ounces (or 1.0 ounce) every thirty days at a flow rate of 0.01 ounces per minute (and/or 1 ounce per second, and/or 0.5 ounces per second, and/or 1.0 ounce per minute).

In this example, the ball 780 is position over an opening and stops the flow of any of the one or more elements from leaving the drip line housing device 785. The ball 780 is held in place by the force of the one or more elements. In this example, the magnet 790 exert a force on the ball 780 to move the ball 780 to the right and/or to the left of the opening on the shelf 783, which allows for flow of the one or more elements out of the reservoir 786 (and/or cartridge) and/or the drip line housing device 785. In one example, when the magnet(s) are turned off, the ball(s) move back to block the opening to stop the flow of one or more elements based on the force of the one or more elements pushing the ball(s) towards the opening(s).

In one example, the reservoir 786 may hold a volume of 6 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 788 may control the flow of the element based on time data, sensor data, imaging data, weight data, PH data, condensation stream data, and/or any other data disclosed in this disclosure. In this example, the controller 788 may send a signal to one or more release devices (discussed in various sections of this disclosure) to release 1.0 ounces of element (e.g., 80-100% vinegar) via turning on the magnet 790 to move ball 780 which allows for a flow stream through the outlet area 778 of the reservoir 786 to the funnel 751 of the drip line device housing 785 to the condensation line 730. The controller 788 may initiate the flow stream of 1.0 ounces every thirty days at a flow rate of 0.001 ounces per minute.

In one example, the reservoir 786 may hold a volume of 40 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 788 may control the flow of the element based on time data, sensor data, imaging data, weight data, PH data, condensation stream data, and/or any other data disclosed in this disclosure. In this example, the controller 788 may send a signal to one or more release devices (discussed in various sections of this disclosure) to release 1.0 ounces of element (e.g., 5-100% vinegar) via turning on the magnet 790 to move ball 780 which allows for a flow stream through the outlet area 778 of the reservoir 786 to the funnel 751 of the drip line device housing 785 to the condensation line 730. The controller 788 may initiate the flow stream of 1.0 ounces based on PH sensor data indicating that the PH level is above a PH threshold (range of 7-10.5) at a flow rate of 0.05 ounces per minute. In another example, the controller 788 may initiate the flow stream of 3.0 ounces based on image data indicating a blocking element is present at a flow rate of 1.0 ounce per 3 seconds or a maximum rate that will not overflow the condensation line 730. In one example, the PH threshold level is 8.0, therefore, when a PH sensor has a reading of 8.0 or over, a treatment may be initiated.

In this example, the ball 780 is position over an opening and stops the flow of any of the one or more elements from leaving the drip line housing device 785. The ball 780 is held in place by the force of the one or more elements. In this example, the magnet 790 exert a force on the ball 780 to move the ball 780 to the right and/or to the left of the opening on the shelf 783, which allows for flow of the one or more elements out of the reservoir 786 (and/or cartridge) and/or the drip line housing device 785. In one example, when the magnet(s) are turned off, the ball(s) move back to block the opening to stop the flow of one or more elements based on the force of the one or more elements pushing the ball(s) towards the opening(s).

In this example, the connection from the drip line device to condensation line element 726 couples the drip line device housing 732 to the condensation line entry point 728.

The one or more elements (e.g., water, sodium hydroxide, vinegar, chlorine, bleach, citric acid, sodium hypochlorite, ammonia, detergent, etc.) either clean out the condensation line and/or change the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

In FIG. 8, a block diagram of a system 800 is shown, according to one embodiment. The block diagram 800 may include a controller 802, one or more processors 804, one or more memory elements 806, an inventory module 808, a maintenance module 810, a cleaning module 812, a warning module 814, a treatment module 816, one or more cameras 818, one or more sensors 820, a number of actuations module 822, one or more displays 824, one or more display modules 826, a time/day module 828, and/or one or more transceivers 830. The block diagram 800 may communicate with a computing device 842 via a hardline 844. Further, communication may occur via the internet 840 utilizing either a hardline (not shown) or a wireless connection. In addition, communication may occur with the computing device 842 via the internet 840, the hardline 844 (and/or 848), and/or one or more wireless connections (846 and 850).

In one example, the inventory module 808 may track and/or report out the amount of one or more elements in the reservoir. In another example, the maintenance module 810 may track and/or report out completed maintenance, maintenance requirements, maintenance warnings, and/or any other data relating to maintenance of the drip line device and/or the condensation line and/or any other device disclosed in this document. In another example, the cleaning module 812 may track and/or report out completed cleanings, cleaning requirements, cleaning warnings, and/or any other data relating to cleaning of the drip lien device and/or the condensation line and/or any other device disclosed in this document. In another example, the warning module 814 may initiate, track, and/or report out any warning relating to any disclosure in this document. In another example, the treatment module 816 may initiate, track, and/or report out any treatment procedures, processes, and/or data relating to one or more treatments. In another example, the one or more cameras 818 may initiate image data, track image data, and/or report out image data. In another example, the one or more sensors 820 may initiate sensor data, track sensor data, and/or report out sensor data. In another example, the number of actuations module 822 may track and/or report out the number of actuations (e.g., delivery of one or more elements) initiated. In another example, the one or more displays 824 may display any data disclosed in this document. In another example, the one or more display modules 826 may track, initiate, and/or report out any display data. In another example, the time/day module 828 may track, initiate, and/or report out any time or day data. In another example, the one or more transceivers 830 may transmit and/or receive any data disclosed in this document.

Figure 9:
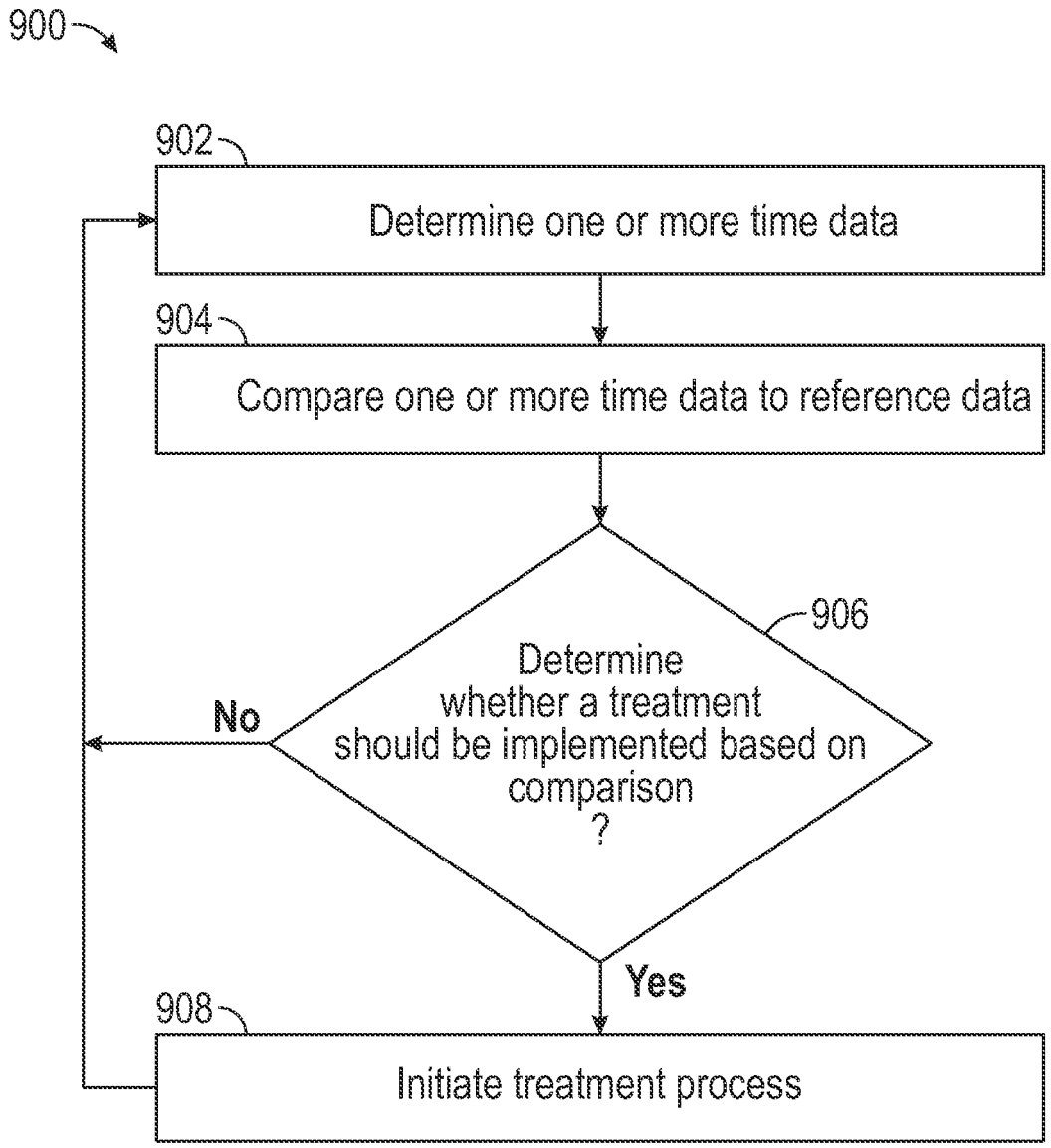
FIG. 9 is a flow chart of the method(s) utilized with the device and/or system, according to various embodiments.

In FIG. 9, a flow chart of the method(s) utilized with the device and/or system is shown, according to various embodiments. In one example, a method 900 may include determining one or more time data via one or more processors, one or more controllers, one or more devices disclosed in this disclosure, and/or one or more modules (step 902). The method 900 may include comparing one or more time data to reference data via one or more processors, one or more controllers, one or more devices disclosed in this disclosure, and/or one or more modules (step 904). The method 900 may include determining whether a treatment should be implemented based on the comparison via one or more processors, one or more controllers, one or more devices disclosed in this disclosure, and/or one or more modules (step 906). If a treatment should not be implemented, then the method 900 moves back to step 902. If a treatment should be implemented, then the method 900 may include initiating a treatment process via one or more processors, one or more controllers, one or more devices disclosed in this disclosure, and/or one or more modules (step 908) and then moving back to step 902.

In one example, one or more processors may receive time data for one or more sources (e.g., clock, etc.). The processors may determine that the time is the targeted time (T) minus 114 hours. The processor may determine that no treatment should be implemented at the present time. The process continues until the processors determine that the current time is the targeted time. At this point, the one or more processors transmit a signal to initiate one of the treatment processes discussed through this document.

Figure 10:
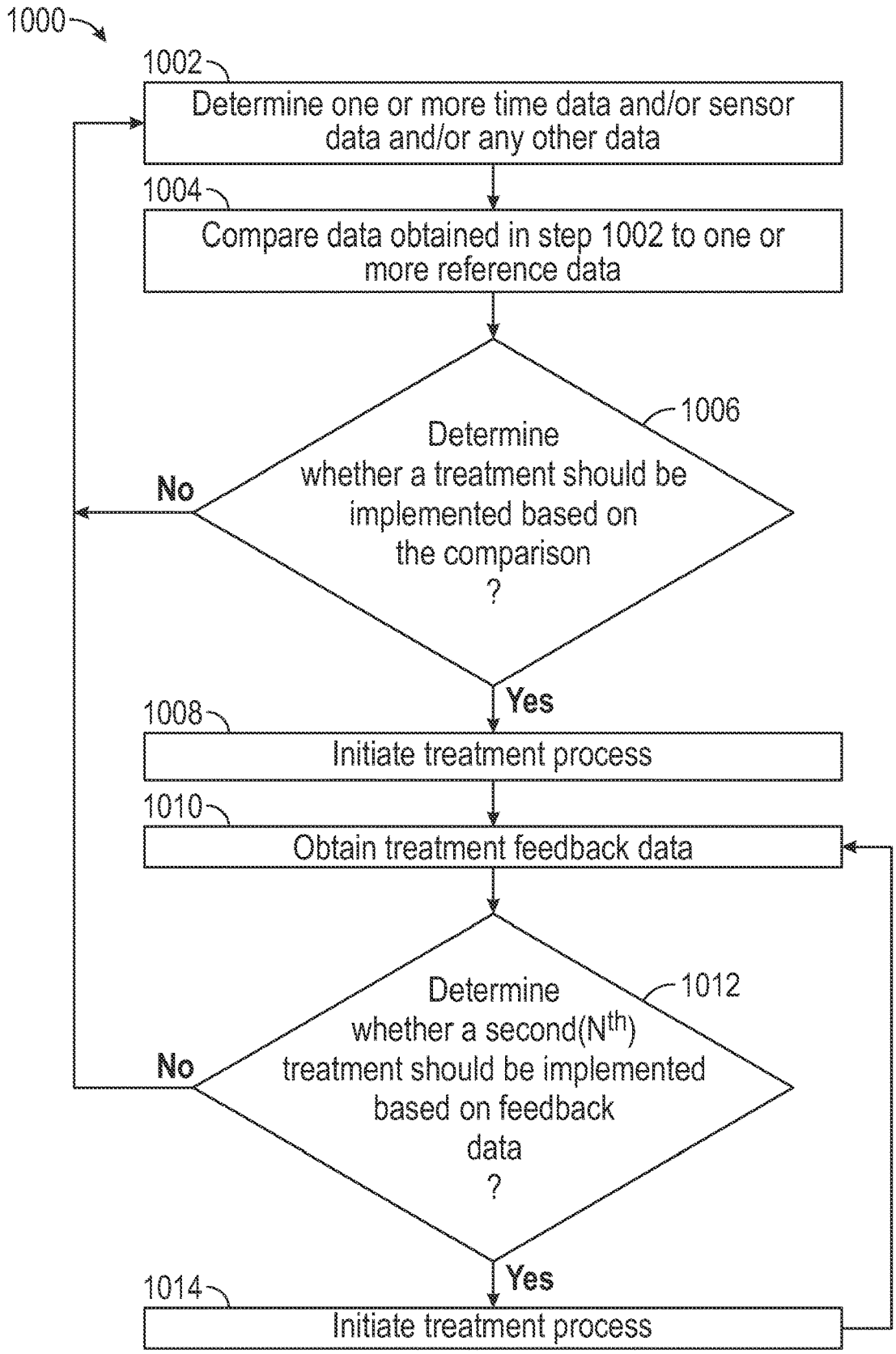
FIG. 10 is a flow chart of the method(s) utilized with the device and/or system, according to various embodiments.

In FIG. 10, a flow chart of the method(s) utilized with the device and/or system is shown, according to various embodiments. A method 1000 may include determining one or more time data and/or sensor data and/or any other data via one or more processors, one or more controllers, one or more devices disclosed in this disclosure, and/or one or more modules (step 1002). The method 1000 may include comparing data obtained in step 1002 to one or more reference data via one or more processors, one or more controllers, one or more devices disclosed in this disclosure, and/or one or more modules (step 1004). The method 1000 may include determining whether a treatment should be implemented based on the comparison via one or more processors, one or more controllers, one or more devices disclosed in this disclosure, and/or one or more modules (step 1006). If a treatment should not be implemented, then the method 1000 moves back to step 1002. If a treatment should be implemented, then the method 900 may include initiating a treatment process via one or more processors, one or more controllers, one or more devices disclosed in this disclosure, and/or one or more modules (step 1008). After the treatment process is initiated, the method 1000 may include obtaining treatment feedback data via one or more processors, one or more controllers, one or more cameras, one or more devices disclosed in this disclosure, and/or one or more modules (step 1010). The method 1000 may include determining whether a second (and/or Nth) treatment should be implemented based on the feedback data (step 1012). If no second (and/or Nth) treatment should be implemented, then the method 1000 may move back to step 1002. If a second (and/or Nth) treatment should be implemented, then the method 1000 may include initiating the second and/or Nth treatment process (step 1014).

In one example, the one or more processors may determine a current time and a condensation stream PH value. In this example, the current time is not the targeted time but the condensation stream PH value is higher than a threshold value (e.g., 7.0, 7.1, 7.2, 7.3, 7.4, . . . , 8.0, 8.1, . . . , and 12.5). Therefore, the one or more processors may initiate one or more treatment procedures based on the PH value being higher than the threshold value. Further, the one or more processors may obtain data after the treatment procedure which indicates that the PH value has been lowered but is still within a predetermined percentage (e.g., 5-10%) of the threshold PH value. In one example, the PH level may have gone from 7.5 to 7.2 but still remains higher than the threshold valve of 7.0. Therefore, the one or more processors may initiate a second treatment procedure. In addition, the one or more processors may receive additional feedback that the condensation line 730 is partial and/or full blocked. Based on this data, the one or more processors may initiate an Nth treatment. Further, the one or more processors may determine after the Nth treatment that a targeted treatment time has now been reached. However, based on the sensor data, the one or more processors may not initiate the treatment procedure based on the target time being reached because of the previous treatments and/or other data.

Figure 11:
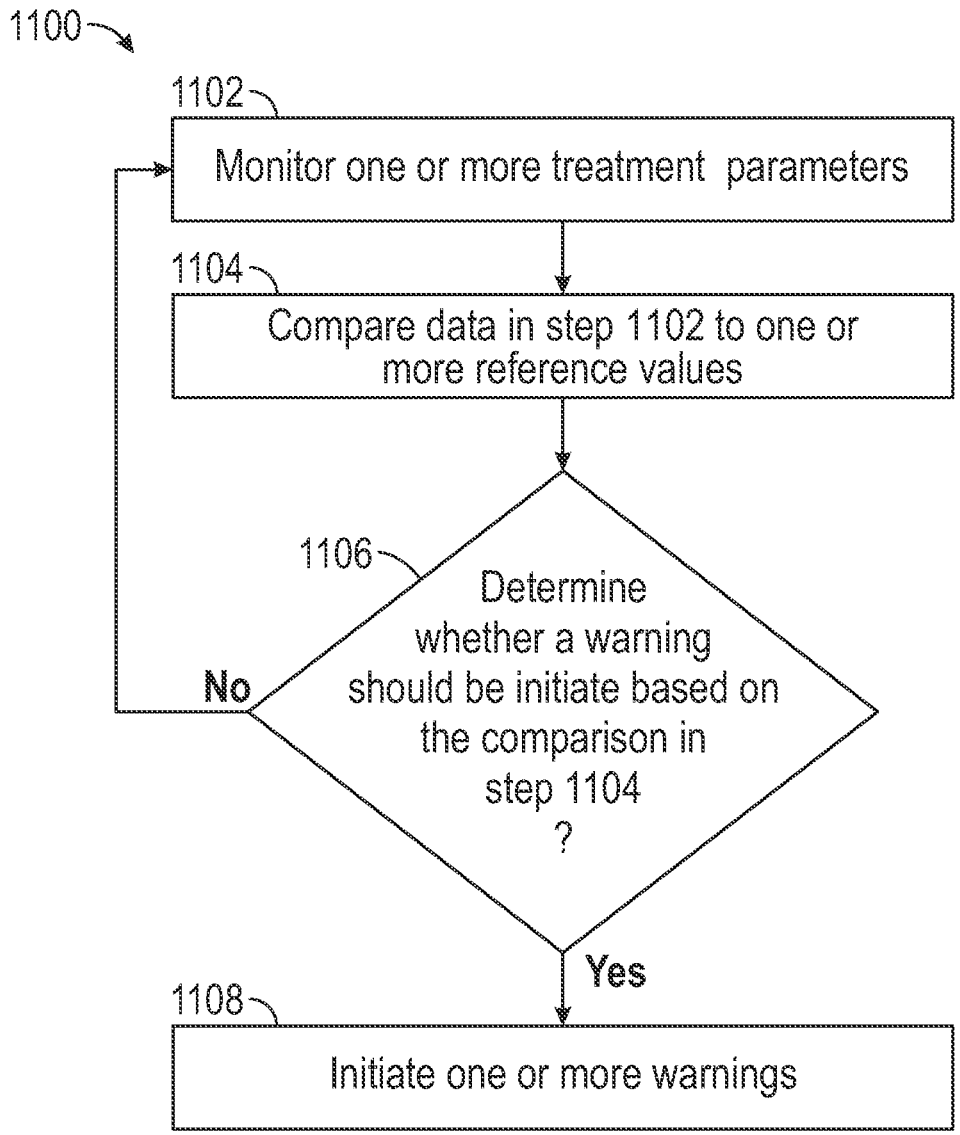
FIG. 11 is a flow chart of the method(s) utilized with the device and/or system, according to various embodiments.

In FIG. 11, a flow chart of the method(s) utilized with the device and/or system, according to various embodiments. In one example, a method 1100 may include monitoring one or more treatment parameters via one or more processors, one or more controllers, one or more devices disclosed in this disclosure, and/or one or more modules (step 1102). The method 1100 may include comparing data from step 1102 to one or more reference values via one or more processors, one or more controllers, one or more devices disclosed in this disclosure, and/or one or more modules (step 1104). The method 1100 may include determining whether a warning should be initiated based on the comparison in step 1104 (step 1106). If no warning should be initiated, then the method 1100 may move back to step 1102. If a warning should be initiated, then the method 1100 may initiate one or more warnings (step 1108) and move back to step 1102.

In one example, the one or more processors may determine a current time and a condensation stream PH value. In this example, the current time is not the targeted time but the condensation stream PH value is higher than a threshold value (e.g., 8.5 PH level). Therefore, the one or more processors may initiate one or more treatment procedures based on the PH value being higher than the threshold value. Further, the one or more processors may obtain data after the treatment procedure which indicates that the PH value has been lowered but is still within a predetermined percentage (e.g., 5-10%) of the threshold PH value (e.g., 7.5 PH level). Therefore, the one or more processors may initiate a second treatment procedure. In addition, the one or more processors may receive additional feedback that the condensation line 730 is partial and/or full blocked. Based on this data, the one or more processors may initiate an Nth treatment. The processors may determine that the condensation line 730 is still blocked after the Nth treatment and initiate a warning. Further, the one or more processors may compare a reservoir level to a threshold level and initiate a warning based on the reservoir level shrinking to a predetermined level (e.g., empty, 10% left, etc.). Further, the one or more processors may receive flow data relating to the reservoir and/or the drip pan line drive which indicates a clogged or partially clogged area. Based on this information relating to clogged or partially clogged areas, the one or more processors may initiate a warning. The processors may receive weight data relating to the reservoir and initiate a warning based on the weight data surpassing a threshold value.

Figure 12:
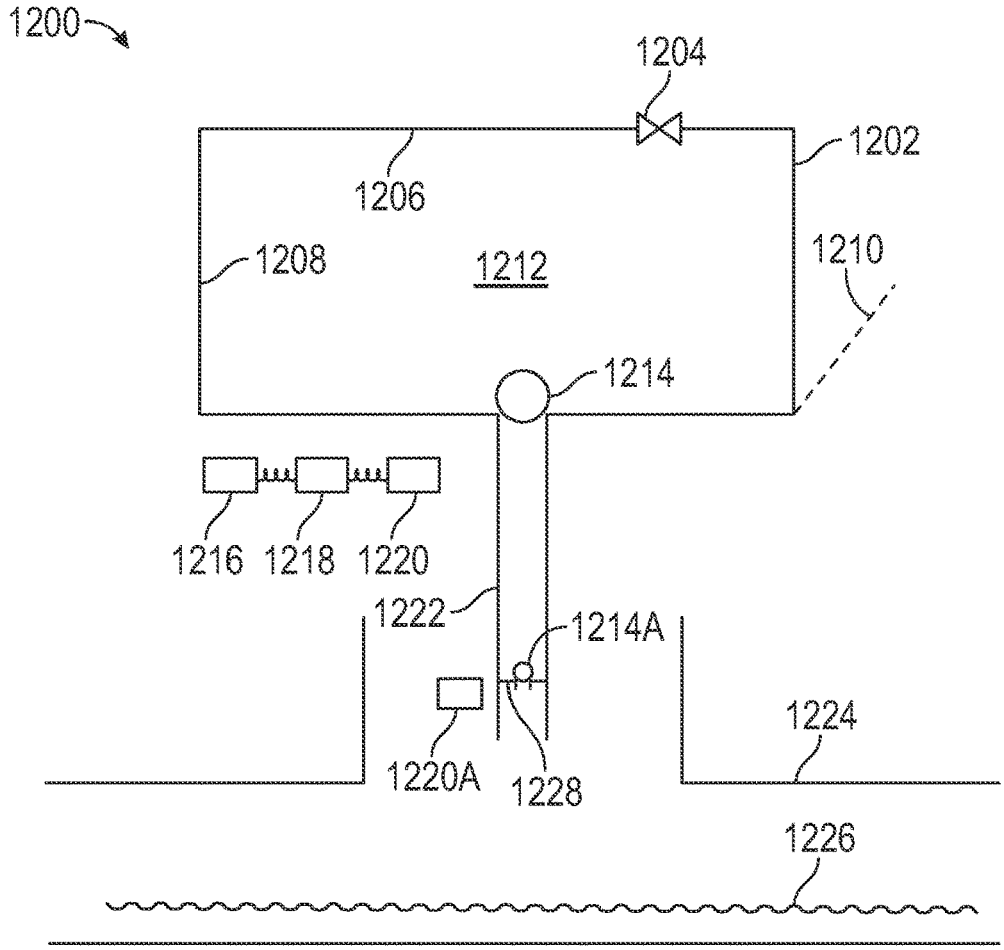
FIG. 12 is another illustration of a drip line device, according to one embodiment.

In FIG. 12, another illustration of a drip line device 1200 is shown, according to one embodiment. Drip line device 1200 may include a reservoir 1202, an air transfer device 1204 (e.g., pressure release device), a length side 1206, a height side 1208, a width side 120, one or more elements 1212, a first ball 1214, a second ball 1214A, a power source 126, a controller 1218, a first magnet 1220, a second magnet 1220A, a head pressure line 1222, and/or a shelf area 1228. In this example, a condensation line 1224 has a stream 1226 of condensation.

In one example, the drip line device 1200 may include a cartridge outlet area where the ball 1214 is positioned to stop of flow of one or more elements 1212. Further, the shelf 783 is present to allow the ball 1214 to move which allows one or more elements from the reservoir 1202 to be delivered to the condensation line 1224. In this example, the reservoir 1202 has a height 1208, a length 1206, and a width 1210. In one example, the height 1208 is 3 inches; the length 1206 is 4 inches; and the width 1210 is 1 and ½ inches. It should be noted that the height 1208 may be any number from 0.1 inches to 10 inches; the length 1206 may be any number from 0.1 inches to 10 inches; and the width 1210 may be any number from 0.1 inches to 10 inches. Further, any number and/or configuration can be utilized and/or any shape (e.g., rectangle, square, circle, etc. and/or any combinations of shapes can be utilized).

In a first example, the first ball 1214 is located at the top of the head pressure line 1222 and there may be no second ball 1214A and/or second magnet 1220A. However, in another embodiment, the second ball 1214A may be located at the bottom end of the head pressure line 1222 which may improve the transmission of one or more elements from the reservoir 1202 to the condensation line 1224 and/or the condensation stream 1226. In addition, the second magnet 1220A may move the second ball 1214A. In this example with the second ball 1214A, there may be no first ball 1214 and/or first magnet 1220. However, the second magnet 1220A would be connected and controlled by controller 1218. In another embodiment, both the first ball 1214 and the second ball 1214A would be utilized, along with the first magnet 1220 and the second magnet 122A, which would both be controlled by controller 1218.

In these examples, the controller 1218 may be coupled to a first magnet 1220 and/or the second magnet 1220A via the power/control line.

In this example, the ball 1214, 1214A is made of ferromagnetic material. The ball 1214, 1214A may also be coated in a non-corrosive material. This non-corrosive material allows the ball 1214, 1214A to resist corrosion while allowing the magnet 1220, 1220A to move the ball 1214, 1214A.

In one example, the reservoir 1202 may hold a volume of 25 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 1218 may control the flow of the element based on time data, sensor data, imaging data, weight data, PH data, condensation stream data, and/or any other data disclosed in this disclosure. In this example, the controller 1218 may send a signal to one or more release devices (discussed in various sections of this disclosure) to release 2.0 ounces of element (e.g., 80-100% vinegar) via turning on one or more of the first magnet 1220 and/or the second magnet 1220A to move one or more of the first ball 1214 and/or the second ball 1214A which allows for a flow stream through the outlet area of the reservoir 1202 and/or the head pressure line 1222 to the condensation line 1224. The controller 1218 may initiate the flow stream of 2.0 ounces every thirty days at a flow rate of 0.0001 ounces per minute.

In this example, the ball 1214, 1214A is position over an opening and stops the flow of any of the one or more elements from leaving the reservoir 1202 and/or the head pressure line 1222. The ball(s) are held in place by the force of the one or more elements. In this example, the magnet(s) 1220, 1220A exert a force on the balls to move the balls to the right and/or to the left of the opening on the shelf, which allows for flow of the one or more elements out of the reservoir 1202 (and/or cartridge) and/or the drip line housing device (shown in FIGS. 7A-7E).

In one example, the reservoir 1202 may hold a volume of 15 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 1218 may control the flow of the element based on time data, sensor data, imaging data, weight data, PH data, condensation stream data, and/or any other data disclosed in this disclosure. In this example, the controller 1218 may send a signal to one or more release devices (discussed in various sections of this disclosure) to release 1.5 ounces of element (e.g., 80-100% vinegar) via turning on one or more of the first magnet 1220 and/or the second magnet 1220A to move one or more of the first ball 1214 and/or the second ball 1214A which allows for a flow stream through the outlet area of the reservoir 1202 and/or the head pressure line 1222 to the condensation line 1224. The controller 1218 may initiate the flow stream of 1.5 ounces every thirty days at a flow rate of 0.002 ounces per minute.

In one example, the reservoir 1202 may hold a volume of 38 ounces of element (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the controller 1218 may control the flow of the element based on time data, sensor data, imaging data, weight data, PH data, condensation stream data, and/or any other data disclosed in this disclosure. In this example, the controller 1218 may send a signal to one or more release devices (discussed in various sections of this disclosure) to release 2.25 ounces of element (e.g., 5-100% vinegar) via turning on one or more of the first magnet 1220 and/or the second magnet 1220A to move one or more of the first ball 1214 and/or the second ball 1214A which allows for a flow stream through the outlet area of the reservoir 1202 and/or the head pressure line 1222 to the condensation line 1224. The controller 1218 may initiate the flow stream of 2.25 ounces based on PH sensor data indicating that the PH level is above a threshold at a flow rate of 0.05 ounces per minute. In another example, the controller 1218 may initiate a flow stream of 3.0 ounces based on image data indicating a blocking element is present at a flow rate of 1.0 ounce per 3 seconds or a maximum rate that will not overflow the condensation line 1224.

The one or more elements (e.g., water, sodium hydroxide, vinegar, chlorine, bleach, citric acid, sodium hypochlorite, ammonia, detergent, etc.) either clean out the condensation line and/or change the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

Figure 13:
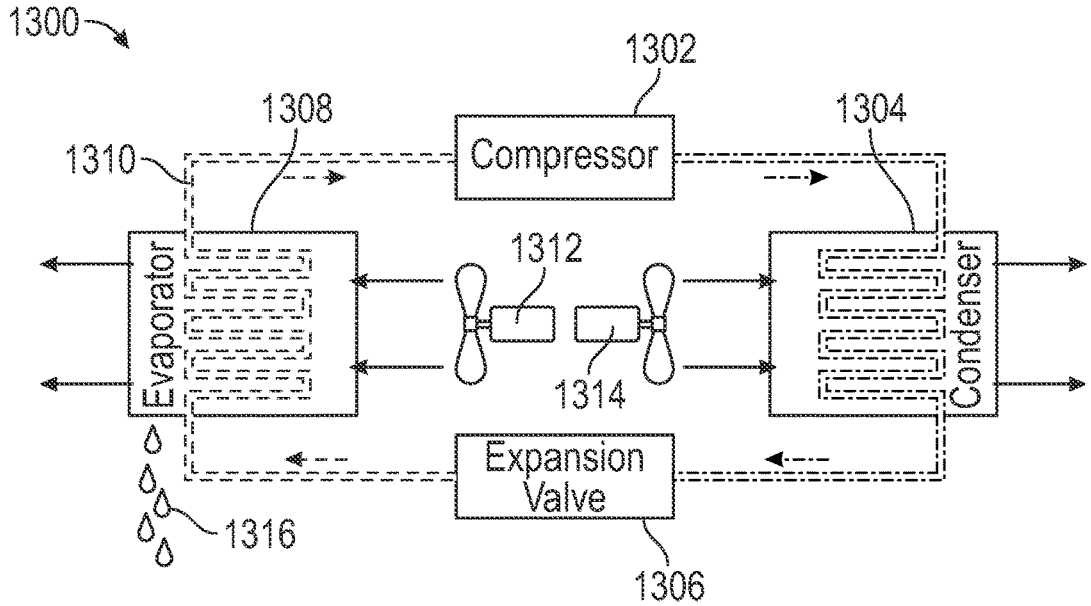
FIG. 13 is an HVAC system.

In FIG. 13, an HVAC system 1300 is shown. HVAC system 1300 may include a compressor 1302, a condenser 1304, an expansion valve 1306, an evaporator 1308, one or more lines 1310, one or more fans 1312, 1314, and condensation 1316 which is produced by the evaporator 1308 (and/or any other element of the HVAC system 1300).

Figure 14:
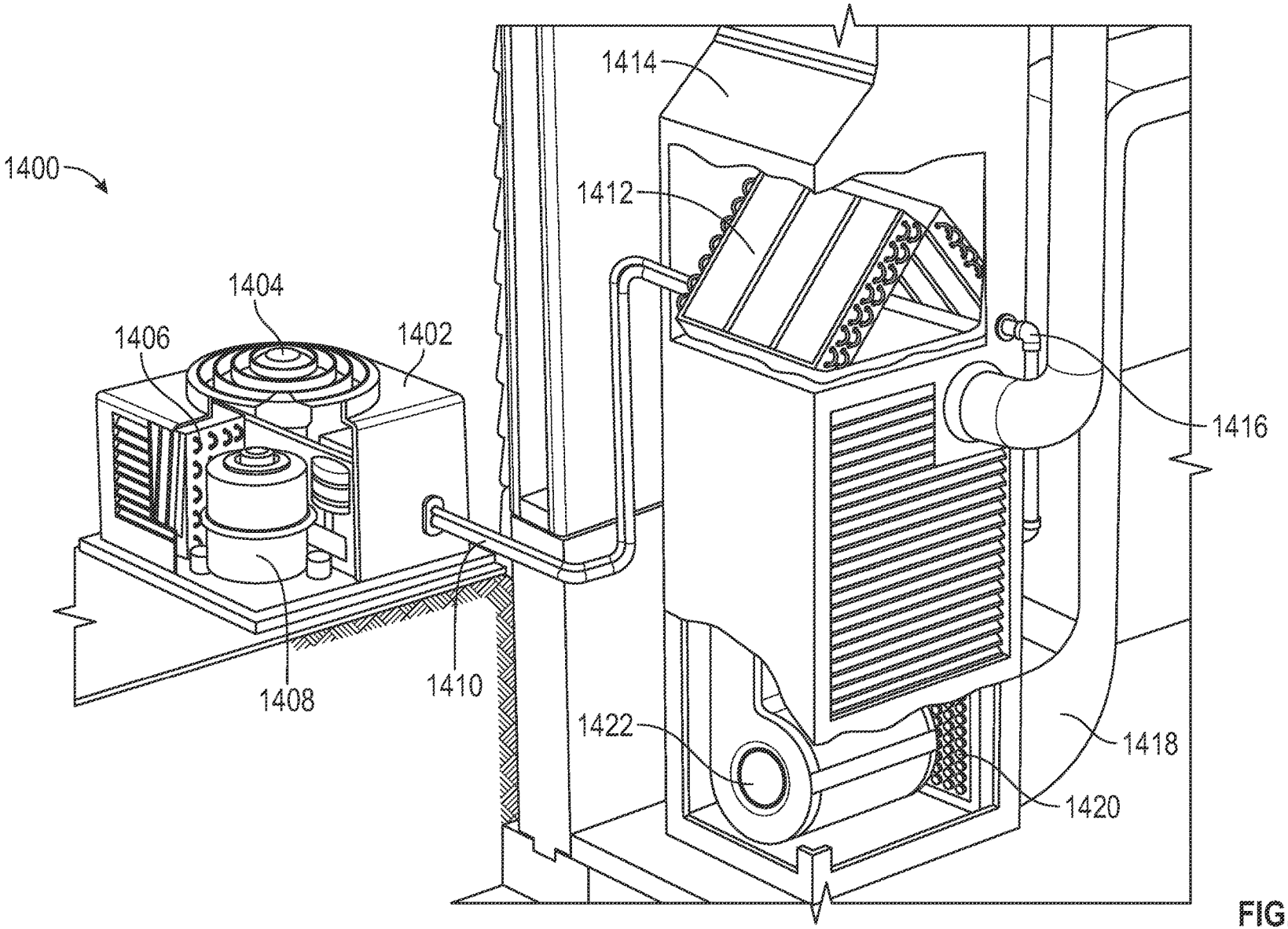
FIG. 14 is an HVAC system.

In FIG. 14, an HVAC system 1400 is shown. HVAC system 1400 may include a condenser unit 1402, one or more fans 1404, a condenser coil 1406, a compressor 1408, one or more coolant lines 1410, an evaporator coil 1412, a plenum 1414, evaporator drain lines 1416 (e.g., condensation lines), a return duct 1418, a filter 1420, and/or a blower 1422.

Figure 15:
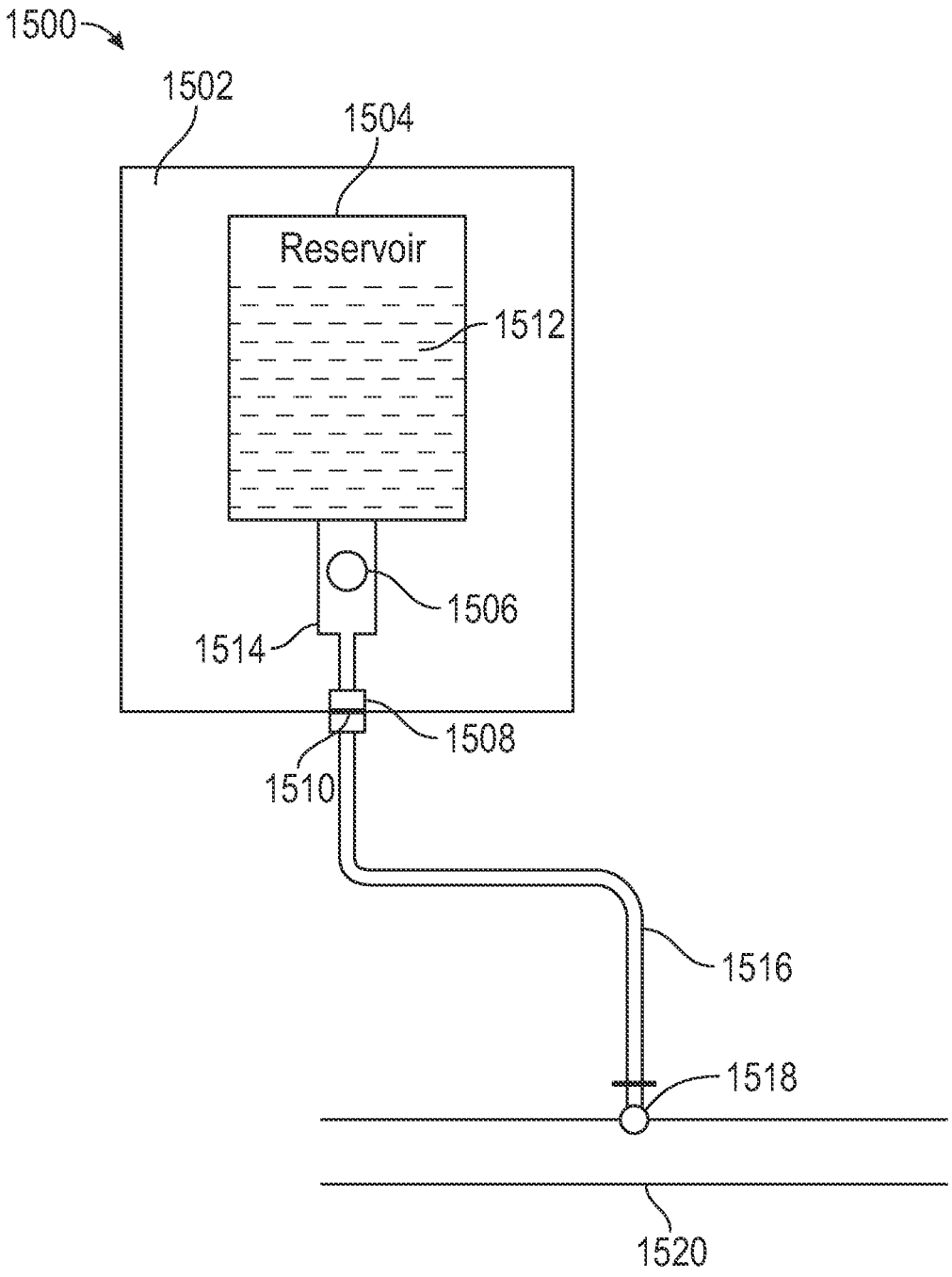
FIG. 15 is another illustration of a drip line device, according to one embodiment.

In FIG. 15, another illustration of a drip line device 1500 is shown, according to one embodiment. Drip line device 1500 may include a housing 1502, a reservoir 1504, a site glass 1506, a level control volume 1508, a valve flow device 1510, one or more elements 1512 in the reservoir 1512, a first outlet area 1514, a tube 1516, and/or a flow control device 1518. In this example, a condensation line 1520 for the HVAC system is shown.

In this example, the reservoir 1504 transports one or more elements 1512 based on gravity to the condensation line 1520. Further, the site glass 1506, the level control volume 1508, the valve flow device 1510, the first outlet area 1514, the tube 1516, and/or the flow control device 1518 control the flow of the one or more elements to achieve a stream of the one or more elements 1512 to the condensation line 1520.

In one example, the reservoir 1504 may contain 60 ounces of one or more elements (e.g., vinegar (e.g., (5% percent vinegar, 10% vinegar, . . . , 100% vinegar) and/or water, sodium hydroxide, vinegar, chlorine, bleach, citric acid, sodium hypochlorite, ammonia, detergent, and/or any other element disclosed in this disclosure). In this example, the site glass 1506, the level control volume 1508, the valve flow device 1510, the first outlet area 1514, the tube 1516, and/or the flow control device 1518 controls the flow of the one or more elements at a rate of 0.16666 ounces per day. In this example, the 0.16666 ounces per day of the one or more elements 1512 is streamed to the condensation line 1520.

The one or more elements (e.g., water, sodium hydroxide, vinegar, chlorine, bleach, citric acid, sodium hypochlorite, ammonia, detergent, etc.) either clean out the condensation line and/or change the PH of the stream. In one example, the one or more elements flush out the bacteria and/or sludge and/or any other blocking element. In another example, the one or more elements change the PH level of the stream which either eliminates or reduces the growth of the bacteria. In another example, the one or more elements complete both tasks and flush away the bacteria and/or sludge and/or any other blocking element while changing the PH level of the stream which either eliminates or reduces bacteria growth.

In one embodiment, a condensation device may include: a reservoir including one or more elements; a power supply; and/or a controller which may receive time data and may control a pump (and/or any other device). The pump (and/or any other device) may transport the one or more elements to a condensation stream.

In another example, the condensation stream may be on a drip pan. Further, the condensation stream may be in a drip line. In another example, the controller may transmit a control signal to the pump (and/or any other device) to transport the one or more elements to the condensation stream based on time data. Further, the controller may compare a current time data to a reference time data and transmit the control signal to the pump to transport the one or more elements to the condensation stream based on a comparison of the current time data to the reference time data. In addition, the controller may receive sensor data and/or any other data in this disclosure. Further, the controller may compare a received sensor data (and/or any other received data) to a reference sensor data (and/or any other reference data) and transmit the control signal to the pump (and/or any other device) to transport the one or more elements to the condensation stream based on a comparison of the received sensor data (and/or any other received data) to a reference sensor data (and/or any other reference data).

In another embodiment, the condensation device may include: a housing including one or more magnets and a condensation line attachment device; a cartridge attachable to the housing, the cartridge including a funnel with a shelf, a ball, and one or more elements; a power supply; and/or a controller coupled to the housing, the power supply, and the one or more magnets, the controller may control the one or more magnets to move the ball on the shelf, the controller configured to receive time data.

In another example, the controller may transmit a control signal to the magnets to move the ball which allows for a transportation of the one or more elements to a condensation stream based on time data. Further, the controller may compare a current time data to a reference time data and transmit the control signal to the one or more magnets to transport the one or more elements to the condensation stream based on a comparison of the current time data to the reference time data. Further, the controller may receive sensor data and/or any other data. In addition, the controller may compare a received sensor data (and/or any other data) to a reference sensor data (and/or any other reference data) and transmit the control signal to the one or more magnets to transport the one or more elements to the condensation stream based on a comparison of the received sensor data (and/or any other data) to a reference sensor data (and/or any other reference data).

In another embodiment, a condensation device may include: a reservoir including one or more elements, a gas pressure valve, and an outlet area; a head pressure line including a shelf and a head pressure line outlet area coupled to the reservoir at the outlet area of the reservoir and an inlet area of the head pressure line; a housing coupled to a power source a controller, and a magnet; and/or a ball located at the head pressure line outlet area. The controller may activate the magnet to move the ball to allow one or more elements to exit the head pressure line outlet area.

In another example, the controller may transmit a control signal to the magnet to move the ball which allows for a transportation of the one or more elements to a condensation stream based on time data. In addition, the controller may compare a current time data to a reference time data and transmit the control signal to the magnet to transport the one or more elements to the condensation stream based on a comparison of the current time data to the reference time data. Further, the controller may receive sensor data (and/or any other data). In addition, the controller may compare a received sensor data (and/or any other data) to a reference sensor data (and/or any other reference data) and transmit the control signal to the magnet to transport the one or more elements to the condensation stream based on a comparison of the received sensor data (and/or any other data) to a reference sensor data (and/or any other reference data). Further, the controller may receive PH data and to compare a current PH data to a reference PH data and transmit the control signal to the magnet to transport the one or more elements to the condensation stream based on a comparison of the current PH data to the reference PH data. In addition, the controller may receive imaging data and to compare a current imaging data to a reference imaging data and transmit the control signal to the magnet to transport the one or more elements to the condensation stream based on a comparison of the current imaging data to the reference imaging data. In a further example, the controller may compare a current time data to a reference time data and transmit the control signal to the magnet to transport the one or more elements to the condensation stream based on a comparison of the current time data to the reference time data. The controller may receive PH data after the one or more elements have been delivered to the condensation stream based on the comparison of the current time data to the reference time data and compare a current PH data to a reference PH data and transmit the control signal to the magnet to transport the one or more elements to the condensation stream based on a comparison of the current PH data to the reference PH data.

In various examples, the release device may be one or more pumps, one or more balls, one or more magnets, one or more openings, one or more orifices, one or more doors, one or more tabs, one or more valves, one or more hoses, and/or any combination thereof. In various examples, the controller may include one or more timing data devices.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," "another example," "in addition," and/or "further" should be considered to mean that the particular features, structures, or characteristics may be combined in one or more examples. Any combination of any element in this disclosure with any other element in this disclosure is hereby disclosed. For example, any element (e.g., flow rate, capacity, controller, ball, connection device, etc.) presented in FIG. 2A may be combined with any and/or all elements in FIG. 7D. Therefore, any element disclosed in the specification and/or figures may be combined with any other element disclosed in the specification and/or figures. Therefore, an element in the figures for FIG. set 2 may be combined with any and/or all elements in FIG. 12. For brevity, not all figures and/or specification pages are listed in these combination examples but are expressly combinable with each other (e.g., anything (and/or element(s)) in FIG. Set 2 with any other figure(s) (and/or element(s)) and/or data from the specification, anything (and/or element(s)) in FIG. 3 with any other figure(s) (and/or element(s)) and/or data from the specification, anything (and/or element(s)) in FIG. Set 4 with any other figure(s) (and/or element(s)) and/or data from the specification, anything (and/or element(s)) in FIG. Set 6 with any other figure(s) (and/or element(s)) and/or data from the specification, anything (and/or element) in FIG. 6 with any other figure(s) (and/or element(s)) and/or data from the specification, anything (and/or element(s)) in FIG. Set 7 with any other figure(s) (and/or element(s)) and/or data from the specification, anything (and/or element(s)) in FIG. 8 with any other figure(s) (and/or element(s)) and/or data from the specification, anything (and/or element(s)) in FIG. 9 with any other figure(s) (and/or element(s)) and/or data from the specification, anything (and/or element(s)) in FIG. 10 with any other figure(s) (and/or element(s)) and/or data from the specification, anything (and/or element(s)) in FIG. 11 with any other figure(s) (and/or element(s)) and/or data from the specification, anything (and/or element(s)) in FIG. 12 with any other figure(s) (and/or element(s)) and/or data from the specification, anything (and/or element(s)) in FIG. 2B with any other figure(s) (and/or element(s)) and/or data from the specification, anything (and/or element(s)) in FIG. 15 with any other figure(s) (and/or element(s)) and/or data from the specification, and/or anything (and/or element(s)) in FIG. Set 1 with any other figure(s) (and/or element(s)) and/or data from the specification.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. A condensation device comprising:

a housing including one or more magnets and a condensation line attachment device;

a cartridge attachable to the housing, the cartridge including a funnel with a shelf, a ball, and one or more elements;

a power supply; and a controller coupled to the housing, the power supply, and the one or more magnets, the controller configured to receive time data, and the controller configured to control the one or more magnets to move the ball on the shelf based on the received time data.

2. The condensation device of claim 1, wherein the controller is configured to transmit a control signal to the one or more magnets to move the ball which allows for a transportation of the one or more elements to a condensation stream based on the received time data.

3. The condensation device of claim 2, the controller is configured to compare a current time data to a reference time data and transmit the control signal to the one or more magnets to transport the one or more elements to the condensation stream based on a comparison of the current time data to the reference time data.

4. The condensation device of claim 1, wherein the controller is configured to receive sensor data.

5. The condensation device of claim 4, wherein the controller is configured to compare a received sensor data to a reference sensor data and transmit the control signal to the one or more magnets to transport the one or more elements to a condensation stream based on a comparison of the received sensor data to the reference sensor data.

* * * * *